US006231728B1

(12) United States Patent
Metzger

(10) Patent No.: US 6,231,728 B1
(45) Date of Patent: May 15, 2001

(54) ELECTROPLATING APPARATUS

(76) Inventor: Hubert F. Metzger, 1940 Lone Oak Cir. East, Brookfield, WI (US) 53045

( * ) Notice: Subject to any disclaimer, the term of this patent is extended or adjusted under 35 U.S.C. 154(b) by 0 days.

(21) Appl. No.: 09/345,263

(22) Filed: Jun. 30, 1999

Related U.S. Application Data

(63) Continuation-in-part of application No. 09/151,317, filed on Sep. 11, 1998, which is a continuation-in-part of application No. 08/939,803, filed on Sep. 30, 1997, now Pat. No. 5,725,231, which is a continuation-in-part of application No. 08/854,879, filed on May 12, 1997, now abandoned, which is a continuation-in-part of application No. 08/755,488, filed on Nov. 22, 1996, now abandoned.

(51) Int. Cl.[7] ..... C25D 17/00; C25B 15/00

(52) U.S. Cl. ..... 204/212; 204/222; 204/240; 204/241

(58) Field of Search ..... 204/273, 212, 204/222, 237, 241, 238, 232, 240

(56) References Cited

U.S. PATENT DOCUMENTS

| | | |
|---|---|---|
| 2,702,260 | 2/1955 | Massa . |
| 3,351,539 | 11/1967 | Branson . |
| 3,647,646 | 3/1972 | Tucker et al. . |
| 3,923,610 | 12/1975 | Bergin et al. . |
| 3,933,601 | 1/1976 | Ishibashi et al. . |
| 4,352,727 | 10/1982 | Metzger . |
| 4,503,769 | 3/1985 | Andersen . |
| 4,812,219 | 3/1989 | Sattrup et al. . |
| 4,830,758 | 5/1989 | Bodne . |
| 5,409,594 | 4/1995 | Al-Jiboory et al. . |
| 5,707,438 | 1/1998 | Carlton . |
| 5,925,231 | 6/1999 | Metzger . |

FOREIGN PATENT DOCUMENTS

| | | |
|---|---|---|
| 41 13 361 | 4/1990 | (DE) . |
| 0 248 118 | 12/1986 | (EP) . |

OTHER PUBLICATIONS

H.E. Ricks, "Ulstrasonics Improves, Shortens, and Simplifies Plating Operations," MPM, pp. 47–49 (Mar. 1962) Best Available Copy.

W.D. Mogerman, "Ultrasonics in the Plating Industry," Plating, pp. 941–947 (Aug. 1967) Best Available Copy.

Electroplating Engineering Handbook (Van Nostrand Reinhold Company, A. Kenneht Graham, ed. 1971) pp. 165–166 No Month Available.

Ultrasonics General Information (printed from Internet on Nov. 14, 1996; dated Mar. 18, 1995, 3 pages total).

Maurice O'Donoghue, The Ultrasonic Cleaning Process( printed froom Internet on Nov. 14, 1996; dated Mar. 6, 1996, 6 pages total).

J.R. Cox, "The Impact of Electromechanical Engraving Specifications on Streaking and Hazing," Gravure, pp. 12–15, (No Month Available 1994) Best Available Copy.

R. Martin AG brochure entitled "Plating installations type B" (selected pages) (no date) 4 pages total.

Dixon Ticonderoga Company, "Grapho Kote No. 4 Ladle Coating," Product Data Sheet PDS—G332, 1 page (no date).

Crest Ultrasonics Corporation, "Martin Walter Push–Pull™ Transducers" Technical Specifications (2 pages, no date).

*Primary Examiner*—Donald R. Valentine
(74) *Attorney, Agent, or Firm*—Foley & Lardner

(57) ABSTRACT

An apparatus for electroplating and deplating a rotogravure cylinder out of a plating solution is disclosed. The apparatus includes a plating tank adapted to rotatably maintain the cylinder and to contain a plating solution so that the cylinder is at least partially disposed into the plating solution. The apparatus also includes a non-dissolvable conductor at least partially disposed within the plating solution. A current source is electrically connected to the non-dissolvable conductor and to the cylinder. An ultrasonic system to introduce wave energy into the plating solution includes at least one transducer element mountable within the tank and a power generator adapted to provide electrical energy to the transducer element. A holding tank having a circulating pump and heating and cooling elements for the plating solution may be provided.

23 Claims, 29 Drawing Sheets

FIG. 24
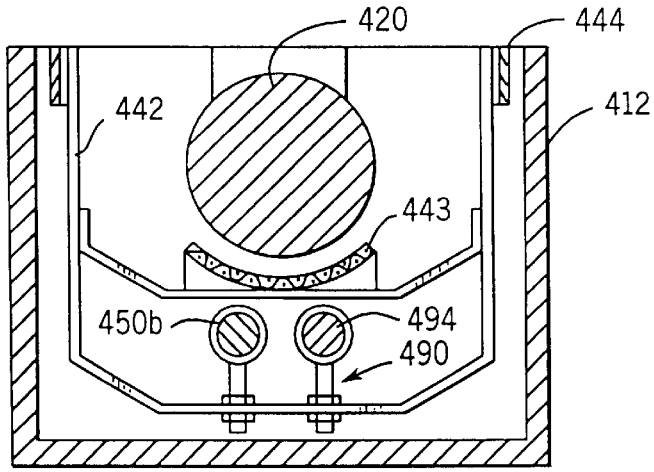
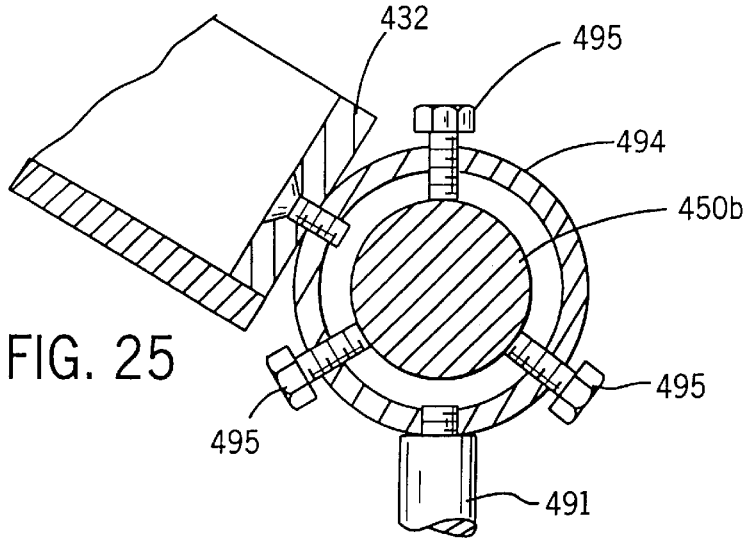
FIG. 25
FIG. 26
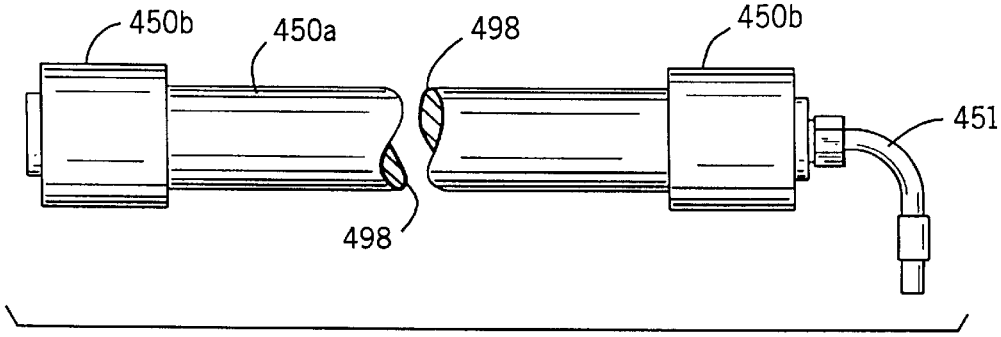

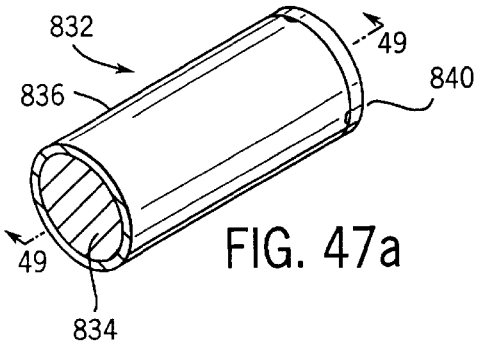
FIG. 47a
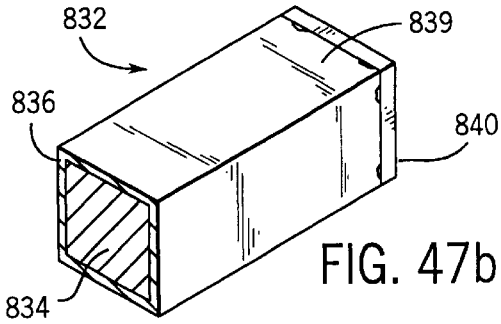
FIG. 47b
FIG. 47c
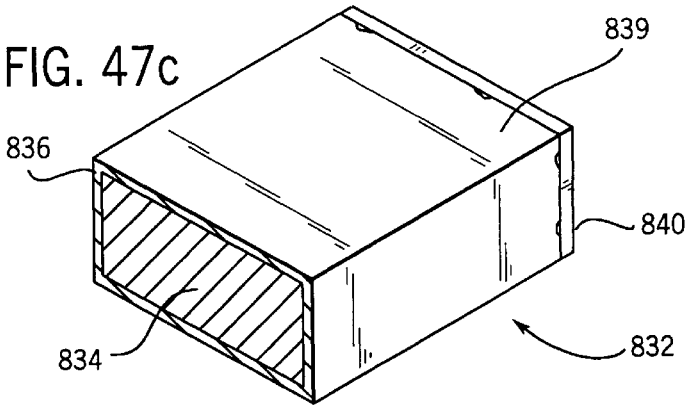
FIG. 48a
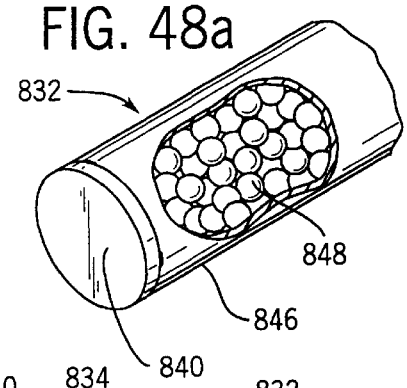
FIG. 48b
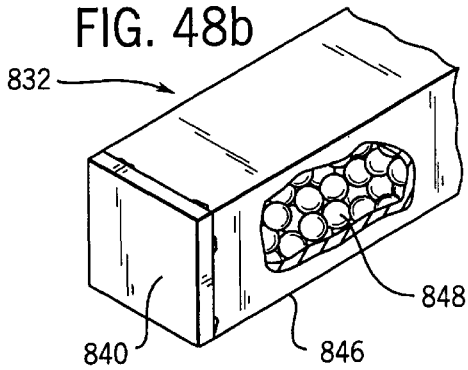
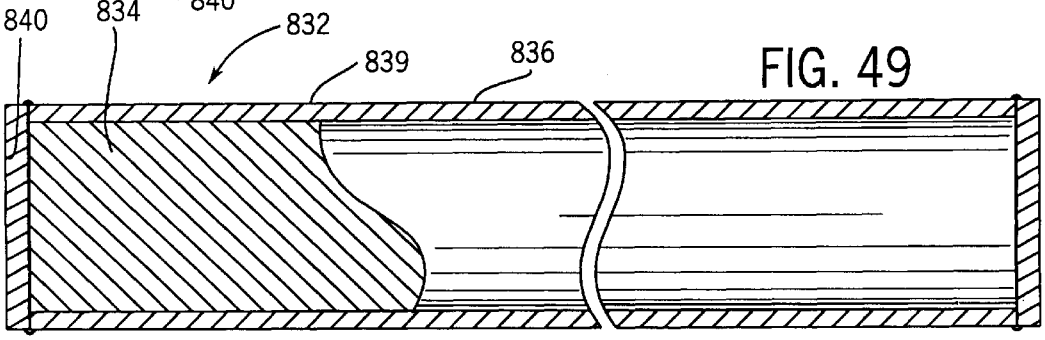
FIG. 49

ELECTROPLATING APPARATUS

RELATED APPLICATIONS

This application is a continuaton-in-part of application Ser. No. 09/151,317, titled "Apparatus for Electroplating Rotogravure Cylinder Using Ultrasonic Energy," filed Sep. 11, 1998, pending incorporated by reference herein, which is in turn a continuation-in-part of application Ser. No. 08/939,803, titled "Apparatus and Method for Electroplating Rotogravure Cylinder Using Ultrasonic Energy," filed Sep. 30, 1997, now U.S. Pat. No. 5,725,231, incorporated by reference herein, which is in turn a continuation-in-part of application Ser. No. 08/854,879, titled "Rotogravure Cylinder Electroplating Apparatus Using Ultrasonic Energy," filed May 12, 1997, now abandoned, incorporated by reference herein, which is in turn a continuation-in-part of application Ser. No. 08/755,488, titled "Apparatus for Electroplating Rotogravure Cylinders Using Ultrasonic Energy," filed Nov. 22, 1996, now abandoned, incorporated by reference herein.

FIELD OF THE INVENTION

The present invention relates to an apparatus for electroplating a rotogravure cylinder using a non-dissolvable anode and ultrasonic energy.

BACKGROUND OF THE INVENTION

In a conventional apparatus for the electroplating of a rotogravure printing cylinder, it is customary to rotate the cylinder (electrically charged as a cathode) in a tank filled with an electrolyte bath and copper bars or copper nuggets (electrically charged as an anode), as disclosed in U.S. Pat. No. 4,352,727 issued to Metzger, and incorporated by reference herein (wherein the copper nuggets are supported in a set of baskets made of titanium or of a plastic material and disposed around each side of the cylinder), or simply a plating solution.

In the arrangement shown in U.S. Pat. No. 4,352,727, the top edge of the respective baskets are disposed below the surface of the electrolyte bath so as to ensure free circulation of constantly refreshed (i.e. filtered) electrolytic fluid or solution. Electrolytic fluid is pumped into the tank from a manifold adjacent to the bottom of one of the baskets, in the direction of cylinder rotation. The top of the rotating cylinder to be plated is disposed slightly above the surface level of the electrolytic fluid so that a washing action occurs as the surface of the cylinder breaks across the surface of the electrolyte. Ions move from the copper bars or nuggets through the electrolytic fluid to the surface of the rotating cylinder during the plating process (or in the reverse direction in the deplating process). Where plating is done directly from a plating solution, ions move directly from the solution to the surface of the rotating cylinder.

Over time, refinements of this system have facilitated satisfactory control of the plating process, to achieve the desirable or necessary degree of consistent plating and uniformity in the plated surface of the cylinder. However, the complete process is comparatively slow, and extra polishing steps may be necessary after plating in order to produce a desirable uniform surface (e.g. roughness on grain structure) on the cylinder. According to the known arrangement, the overall efficiency of the process necessary to produce a suitably uniform plated surface on the cylinder can be adjusted either by reducing the current density, which increases the plating time but reduces the number or duration of additional polishing steps, or by increasing the current density, which reduces the plating time but increases the number or duration of additional polishing steps.

Furthermore, in the known arrangement, during operation, a copper sludge may tend to accumulate on and about the cylinder during the plating process, forming uneven and undesirable copper deposits, typically in areas of low current density (such as furthest apart from the copper cylinder). A copper sludge may also build up between the contact surfaces of the titanium baskets or lead contacts. Moreover, other surfaces may become fouled with sludge and other matter.

Ultrasonic wave energy has been used successfully in surface cleaning applications. The long-known advantages in using ultrasonic energy in electroplating have also been described in such articles as "Ultrasonics in the Plating Industry", *Plating*, pp. 141–47 (August 1967), and "Ultrasonics Improves, Shortens and Simplifies Plating Operations," *MPM*, pp. 47–49 (March 1962), both of which are incorporated by reference herein. It has been learned that ultrasonic energy may advantageously be employed to improve the quality (e.g. uniformity and consistency of grain structure) of a plating process by providing for uniformity and efficiency of ion movement. In other applications, it has been found that copper can be plated onto a surface in a production system using ultrasonic energy at up to four times the rate ordinarily possible. It has also been found that the use of ultrasonic energy in an electroplating process provides an increase in both the anode and cathode current efficiency, and moreover, the practical benefit of faster plating with less hydrogen embrittlement (e.g. with less oxidation of the hydrogen on the plating and deplating surfaces).

Accordingly, it would be advantageous to have an apparatus configured to capitalize on the advantages of substantially removing or eliminating from the plating tank any solid material that is soluble or vulnerable to dissolution in the plating solution. It would further be advantageous to have a rotogravure cylinder apparatus employing a non-dissolvable anode to substantially reduce or eliminate the build-up of copper (or other) sludge during the plating process and obtain a more uniform and consistent grain structure on the plated surface of the cylinder. It would also be advantages to have an apparatus configured to employ an anode to enable the usage of an increased current density for faster plating with minimum polishing steps. It would also be advantages to have an apparatus configured to use ultrasonic energy in plating a rotogravure cylinder in order to obtain a more uniform and consistent grain structure on the plated surface of the cylinder through a more efficient process. It would further be advantageous to have a rotogravure cylinder plating apparatus employing ultrasonic energy to eliminate the build-up of copper (or other) sludge during the plating process.

SUMMARY OF THE INVENTION

The present invention relates to an apparatus for electroplating and deplating a rotogravure cylinder out of a plating solution. The apparatus includes a plating tank adapted to rotatably maintain the cylinder and to contain the plating solution so that the cylinder is at least partially disposed into the plating solution, and at least one non-dissolvable conductor at least partially disposed within the plating solution. A current source is electrically connected to the non-dissolvable conductor and to the cylinder. An ultrasonic system introduces wave energy into the plating solution. The ultrasonic system includes at least one transducer element mountable within the tank and a power generator adapted to provide electrical energy to the at least one transducer element.

The present invention relates to an apparatus for electroplating and deplating a rotogravure cylinder out of a plating solution. The apparatus includes a plating tank adapted to rotatably maintain the cylinder and to contain the plating solution so that the cylinder is at least partially disposed into the plating solution, a mounting structure mountable within the plating tank partially on each side of and generally below the cylinder, and at least one non-dissolvable conductor at least partially disposed within the plating solution. The non-dissolvable conductor including a plurality of conductive cores, and a surface material substantially resilient to the plating solution covering at least portions of the conductive cores. A current source is electrically connected to the non-dissolvable conductor and to the cylinder. An ultrasonic system introduces wave energy into the plating solution. The ultrasonic system includes at least one transducer element mountable within the tank to the mounting structure and a power generator adapted to provide electrical energy to the at least one transducer element.

DESCRIPTION OF THE DRAWINGS

FIG. 3 is a perspective view of the apparatus of FIG. 1 showing a basket system adapted to hold copper nuggets or the like.

FIG. 24 is a sectional end and elevation view of the plating tank of FIG. 23.

FIGS. 25 and 25A are sectional views of the mounting arrangement of an ultrasonic transducer element within the plating tank of FIGS. 18 and 18A.

FIG. 26 is a schematic view of an ultrasonic transducer element.

FIG. 47*a* is a fragmentary perspective view of a conductor having a generally circular cross-section.

FIG. 47*b* is a fragmentary perspective view of a conductor having a square cross-section.

FIG. 47*c* is a fragmentary perspective view of a conductor having a generally rectangular cross-section.

FIG. 48*a* is a fragmentary perspective view of an alternate embodiment of a generally circular conductor including a plurality of conductive pieces.

FIG. 48*b* is a fragmentary perspective view of an alternate embodiment of a generally rectangular conductor including a plurality of conductive pieces.

FIG. 49 is a sectional view of the conductor of FIG. 47*a* taken through line 49.

DETAILED DESCRIPTION OF THE PREFERRED EMBODIMENTS

Figure 1:
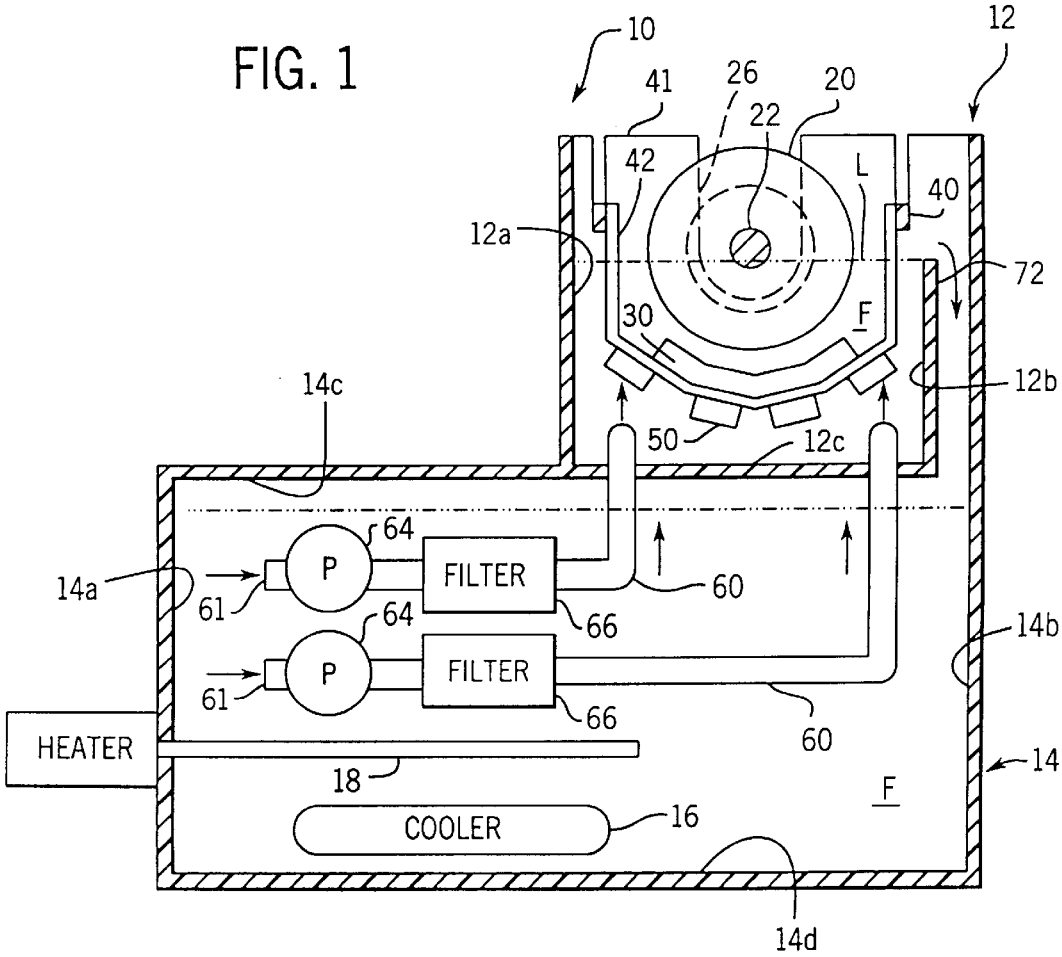
FIG. 1 is a sectional elevation view of an electroplating apparatus for a rotogravure cylinder according to a preferred embodiment of the present invention.

Referring to FIGS. 1 through 4, a preferred embodiment of an apparatus for electroplating a rotogravure cylinder is shown. Apparatus 110 includes a plating tank 12 having side walls 12*a* and 12*b*, and walls 12*d* and 12*e*, and bottom 12*c*. Plating tank 12 as shown in FIG. 1 contains an electrolytic fluid (e.g. copper sulfate or the like in an appropriate solution) indicated by reference letter F at a level (indicated by reference letter L) regulated by the height of a weir 72 (e.g. the top of side wall 12*b*). A rotogravure cylinder 20 to be plated (or deplated) is rotatably supported at its ends (e.g. upon an extending central shaft) to be submerged into the electrolytic fluid approximately on-half to one-third of the cylinder diameter. Cylinder 20 is rotatably supported at its ends by bearings within a journal 22, in which it is rotatably driven by a suitable powering device (not shown). Cylinder 20, shown in the FIGURES as one of a standard size (e.g. having a diameter of approximately 800 to 1500 mm), is disposed in close proximity to a basket system 30; according to alternative embodiments cylinders of other diameters may be accommodated.

According to any preferred embodiment, the tank system and cylinder mounting and drive system are of a conventional arrangement known to those of ordinary skill in the art of rotogravure cylinder plating. In any preferred embodiment, apparatus 10 will include a basket system 30 having one or a plurality of basket compartments 32 formed by a series of side and internal dividing walls 31. Basket system 30 in any preferred embodiment be disposed into the electrolytic fluid below level L of the electrolytic fluid. To ensure complete and constant exchange of the electrolytic fluid, the exterior side walls of basket compartments 32 are maintained below level L, otherwise the flow of electrolytic fluid may stagnate between basket compartments 32 and cylinder 20 and may possibly cause overheating. The electrolytic fluid is itself of a composition known to those of ordinary skill in the art of electroplating; for example, a solution of 220 to 250 gram/liter copper sulfate and 60 gram/liter sulfuric acid, to fill plating tank 12 to level L.

Figure 2:
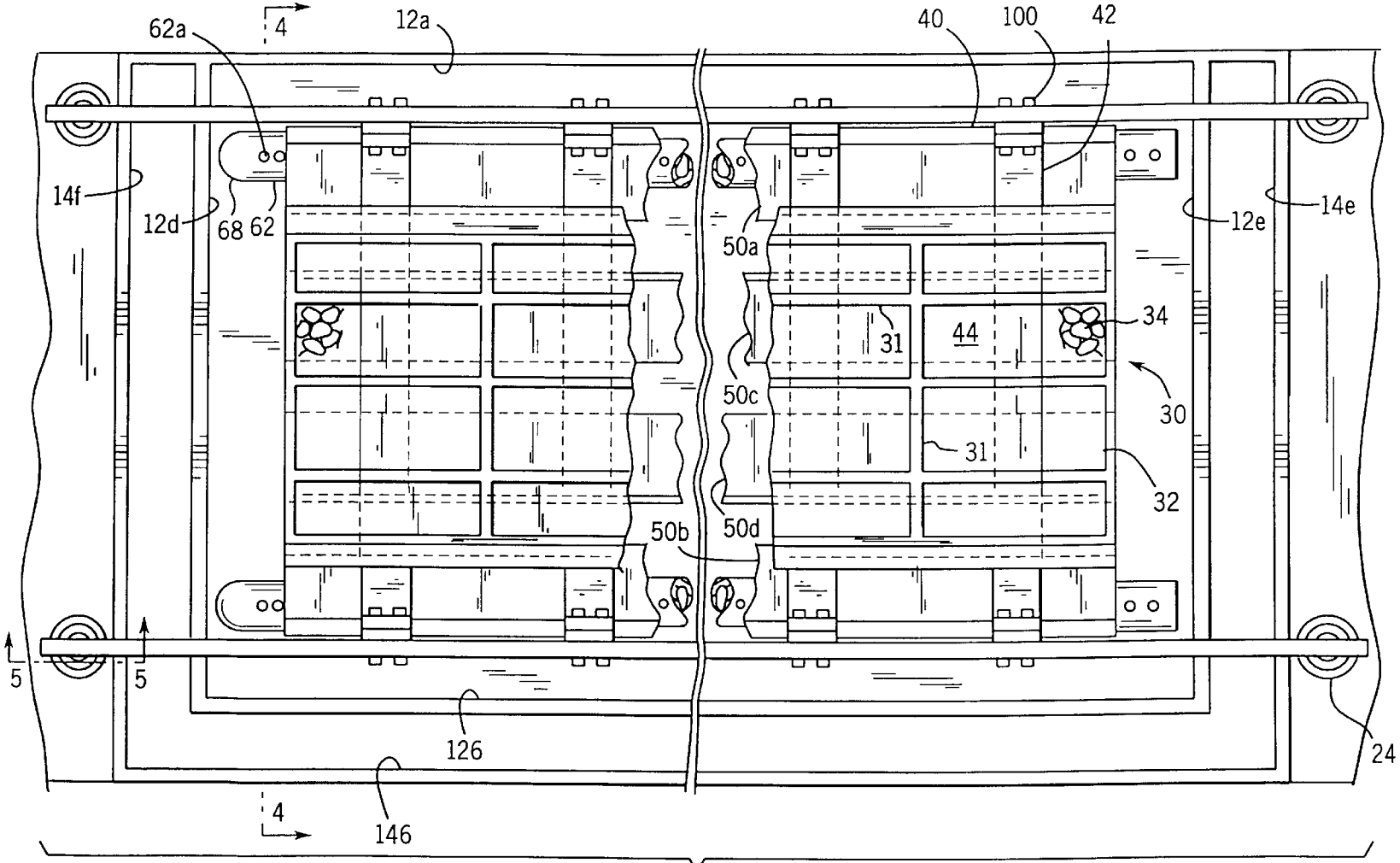
FIG. 2 is a plan and cut-away view of the apparatus of FIG. 1.
Figure 3:
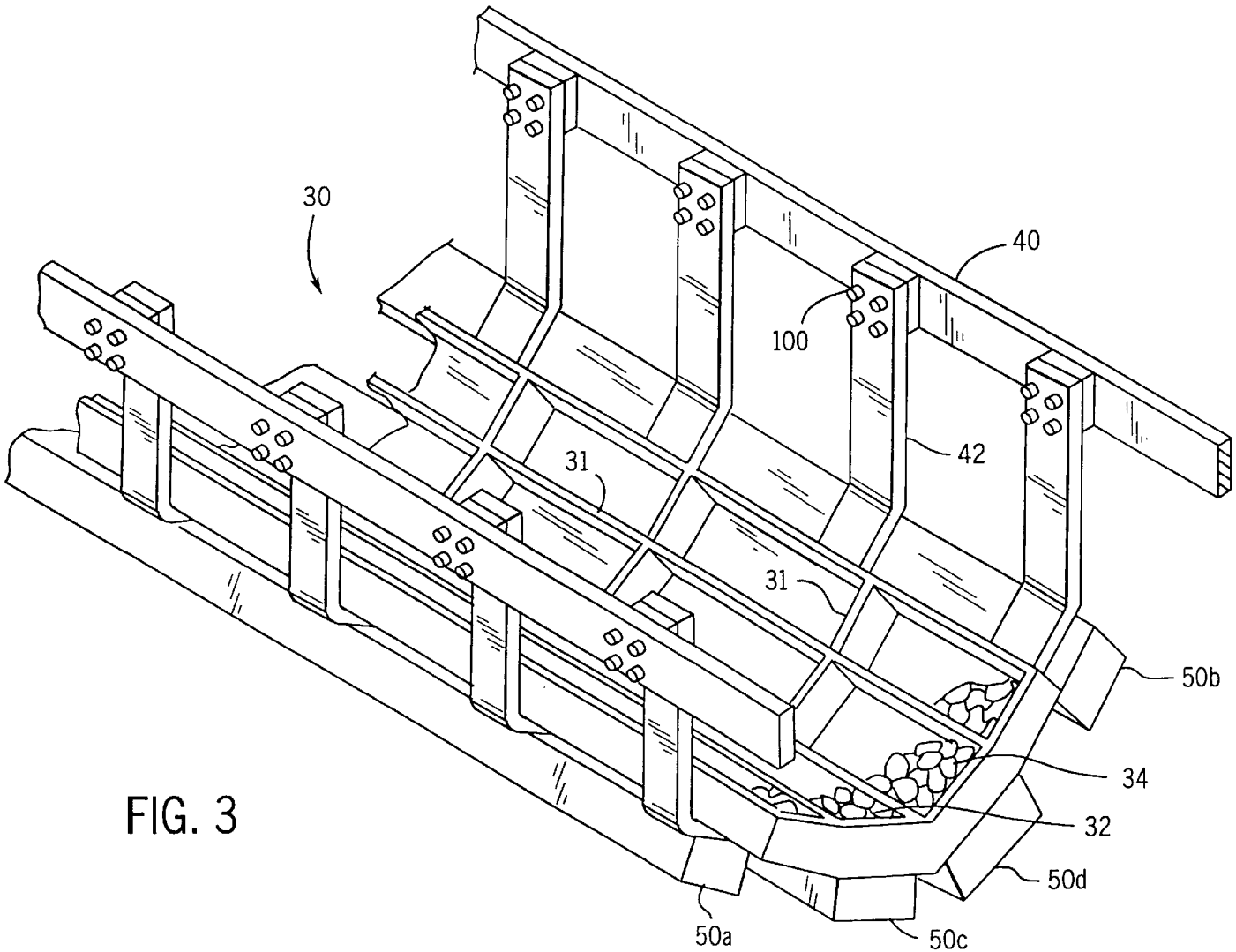
Figure 4:
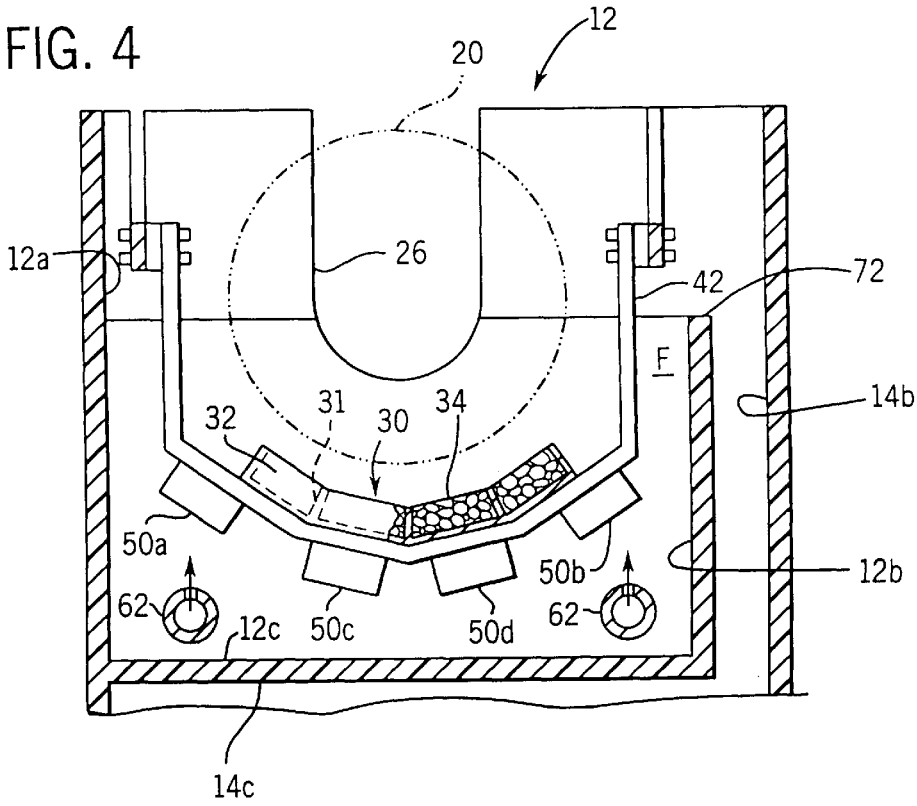
FIG. 4 is a sectional elevation view of a plating tank of the apparatus of FIG. 1 showing a cylinder and the basket system.
Figure 7:
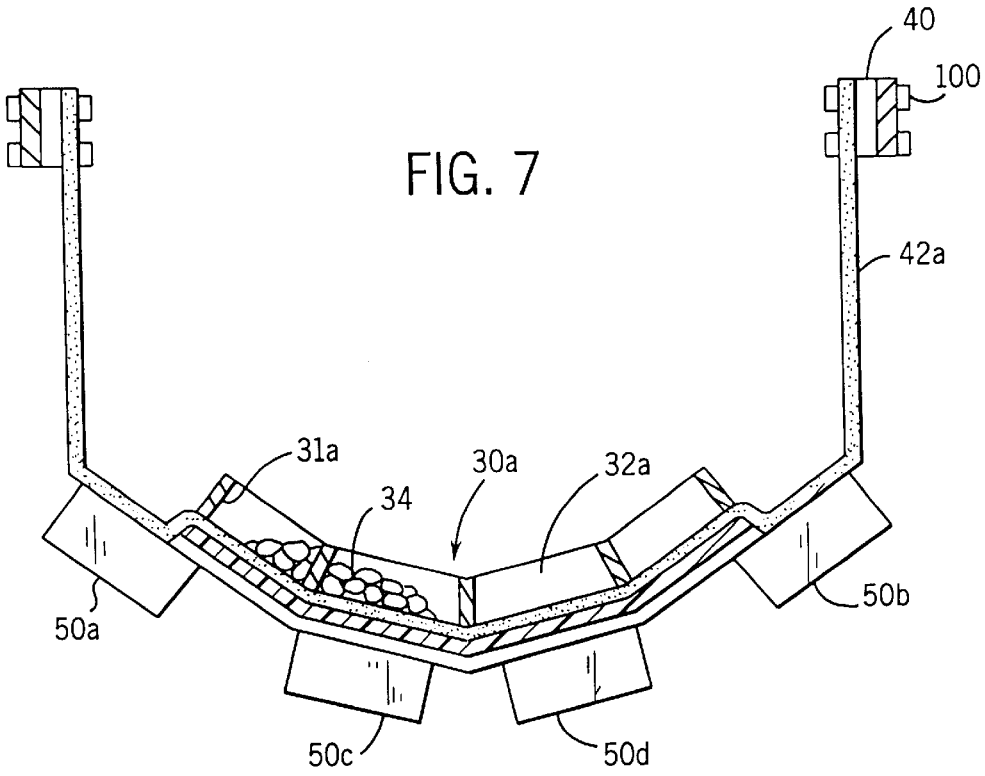
FIG. 7 is a sectional elevation view of the apparatus of FIG. 6.

As shown in FIG. 2, basket compartments 32 of concavo-convex basket system 30 contain nuggets 34 of a metallic material such as copper to be plated onto (or deplated from) cylinder 20. Basket compartments 32 and partitioning walls 31 (shown in FIGS. 2 through 4) are formed from a suitable metallic material, typically titanium, or in an alternative embodiment, from a suitable plastic material such as polypropylene (as shown in FIG. 7). The arrangement of a basket system of this basic type is disclosed in U.S. Pat. No. 4,352,727 issued to Metzger, which is incorporated by reference. As shown in FIG. 4, the basket compartments 32 of basket system 30 have concave walls that are disposed towards the surface of cylinder 20. According to a preferred embodiment, the distance between the anode surface of basket system 30 to the cathode surface of cylinder 20 is approximately 40 to 60 mm. According to any preferred embodiment of the present invention, basket system 30 does not encompass any substantial portion of the outer perimeter of cylinder 20. (This relationship may vary in alternative embodiments which employ a basket system of a larger size relative to the cylinder.) As shown in FIGS. 3 and 4, basket system 30 is suspended from a pair of rails 40 extending along walls 12*a* and 12*b* of plating tank 12 by a series of hangers, shown as lead anodes 42. (Rails 40 are shown mounted from a reinforcing structure 41 in FIG. 1; according to an alternative embodiment, the ends of rails 40 may be supported by the tank ends or side walls.)

Lead anodes 42 provide electrical connection to rails 40 (e.g. bus bars), across basket system 30 and through basket compartments 32 in a manner so also to provide an electrical connection to electrically-conductive nuggets 34. (According to a preferred embodiment, high phosphor copper mini-nuggets, preferably 0.04 to 0.06 percent phosphor, are used.) As shown in FIGS. 3 and 4, nuggets 34 are contained in basket compartments 32 with overlaid plastic sheeting 36 (shown cut away in portions to reveal nuggets 34). (Plastic shield plates may be used when a cylinder of shorter length is plated so as to prevent over-plating at the cylinder ends.) According to this embodiment, lead anodes 42 (e.g. curved flat strips) serve as the structural supports (i.e. hangers) for basket system 30. Lead anodes 42 are mechanically fastened and electrically coupled to current-carrying rails 40 at junctions employing fasteners, shown as bolts 100. (According to a particularly preferred embodiment, the inner walls of basket compartments 32 have perforations and the outer walls of basket compartments 32 are solid, except for two rows of holes near their tops which enable the flow of plating solution through basket compartments 32.) Upper portions 42*a* of the lead anode strips 42 are dip coated to protect them from the electrolytic fluid; and lower portions 42*b* of lead anodes 42 are exposed and positioned within basket compartments 32 to maintain electrical contact with copper nuggets 34. In operation, the packing of copper nuggets 34 around and between lead anodes 42 and cylinder 20 to be plated protects lead anodes 42 against wear.

For plating the cylinder, the rails are connected to an anode side of a plating power supply (e.g. a current source of known design) and the cylinder is connected to a cathode side of the power supply; for de-plating, the anode-cathode connections are reversed. When the cylinder is printed out (i.e. after having been plated and etched), it is returned to the plating apparatus and deplated so as to return the copper to the nuggets.

Figure 8:
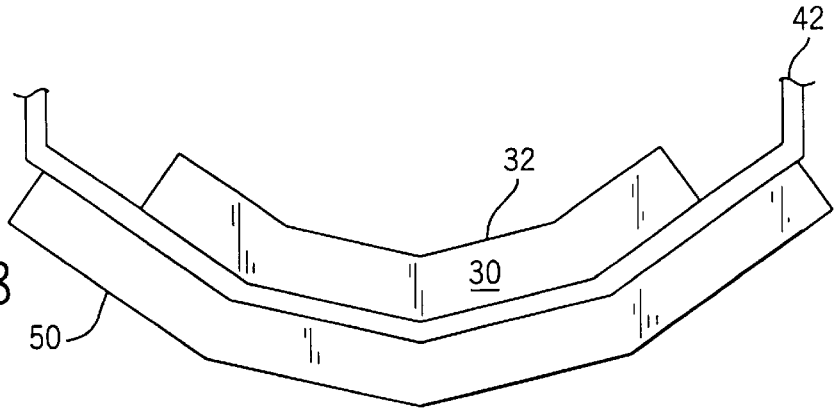
FIG. 8 is a sectional elevation view of a transducer assembly and a basket system for an electroplating apparatus according to an alternative embodiment.

Referring to FIGS. 1 through 4 (and also FIGS. 7 through 9), shown disposed lengthwise along the bottom surface of basket system 30 (e.g. bonded or securely mounted thereto) are ultrasonic transducer elements 50. Transducer elements 50 (shown as four elements 50*a* through 50*d* in FIGS. 1 through 4 and 7) are electrically coupled to a control system (shown schematically in FIG. 10) and are provided to introduce ultrasonic wave energy into plating tank 12. Transducer elements 50 can be of any variety known in the art. According to a particularly preferred embodiment, the transducer elements are designed to provide for operation in a frequency range of 15 to 30 kHz (cycles). In the exemplary embodiment shown in FIG. 1, two of the four transducer elements (e.g. outer transducer elements 50*a* and 50*b*) are configured and positioned in relation to basket system 30 as to assist with the plating process directly (e.g. to facilitate consistency of ion migration through the electrolytic fluid); the remaining two transducer elements (e.g. inner transducer elements 50*c* and 50*d*) are configured and positioned in relation to basket system 30 as to provide a cleaning function and maintain nuggets 34, cylinder 20 and other elements of and about basket system 30 free of copper sludge and other fouling buildup.

As shown in FIG. 1, according to a preferred embodiment, the electrolytic fluid supply system functions as a closed circuit system. A supply of electrolytic fluid F is provided into plating tank 12 by at least one spray bar 62 (two are shown), which consists of a section of pipe or tube extending laterally along or near the bottom of plating tank 12. Each spray bar 62 has a series of apertures 62*a* along its length (as shown at least partially in FIG. 2) that provide for a constant and relatively well-dispersed flow of electrolytic fluid into plating tank 12 from a holding tank 14 (e.g. a reservoir). Holding tank 14 is formed of side walls 14*a* and 14*b*, a bottom 14*d*, a top 14*c*, and end walls 14*d* and 14*e*, and is disposed beneath plating tank 12 (e.g. top 14*c* of holding tank 14 matches bottom 12*c* of plating tank 12) so as to capture any flow of electrolytic fluid travelling over weir 72 in plating tank 12. (Electrolytic fluid F is maintained at its own level in holding tank 14.) Electrolytic fluid may build up heat and increase in temperature over time during the plating (or deplating) process and therefore holding tank 14 is equipped with a fluid cooling system 16 (e.g. a suitable heat exchanger for such fluid of a type known in the art). Likewise, electrolytic fluid may need to be heated from an ambient temperature to a higher temperature at the outset of the plating process and therefore holding tank 14 is also equipped with a fluid heating system 18 (e.g. a suitable heat exchanger for such fluid of a type known in the art). The temperature regulating system for the plating solution can be coupled to an automatic control system that operates from information obtained by temperature sensors in or near one or both tanks, and to control other parameters that may be monitored during the process, according to known arrangements.

During the entire electroplating process, the electrolytic fluid is constantly being filtered and the ultrasonic system is constantly running. Before the electroplating process begins, the ultrasonic system can be energized to provide for agitation of electrolytic fluid and for cleaning of the basket system (to eliminate metallic sludge) to provide for better contact between the metal nuggets and the titanium basket compartments and lead anodes (or the lead anodes themselves in an embodiment having plastic basket compartments).

A pair of supply pipes 60 feed spray bars 62 with a supply flow of electrolytic fluid. Supply pipes 60 each are coupled to a circulation pump 64 and a filter 66 (configured and operated according to a known arrangement). Circulation pumps 64 draw electrolytic fluid F from holding tank 14 into inlets 61 in each of supply pipes 60 and force it under pressure through filters 66 and into spray bars 62 where (having been filtered) it is reintroduced through apertures 62*a* into plating tank 12 for the electroplating process. Each of spray bars 62 extends along the bottom of plating tank 12, rising horizontally from holding tank 14 and turning at an elbow 68 to run horizontally along and beneath basket system 30. According to alternative embodiments, the apparatus could include one pump and filter coupled to either a single spray bar or a spray bar manifold system, or any other combination of elements that provide for the suitable supply of electrolytic fluid into the plating tank.

Figure 5:
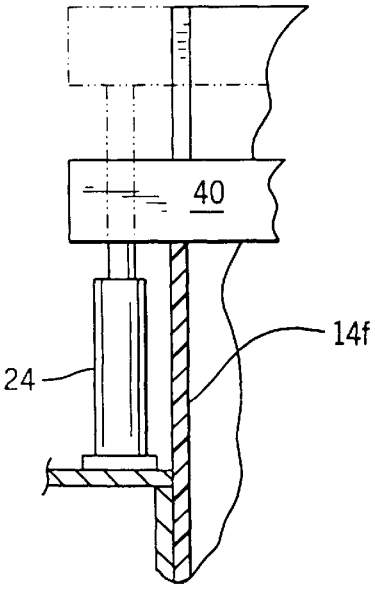
FIG. 5 is a sectional elevation view of a lifter for the apparatus of FIG. 1.

Referring to FIG. 2, a top (and broken away) view of basket system 30, plating tank 12, holding tank 14, and rails 40 are shown disposed on a set of lifters (one is shown as hydraulic cylinder assembly 24 in FIG. 5), which allow the vertical position of the cylinder to be adjusted within plating tank 12 (in a set of end slots 26 in the end walls of the plating tank that are adapted to form a leak-proof seal with the rotating cylinder assembly). The distance from the cylinder surface to the basket system, which is placed underneath the cylinder, may thereby be adjusted, for example, according to the diameter of the cylinder.

Figure 6:
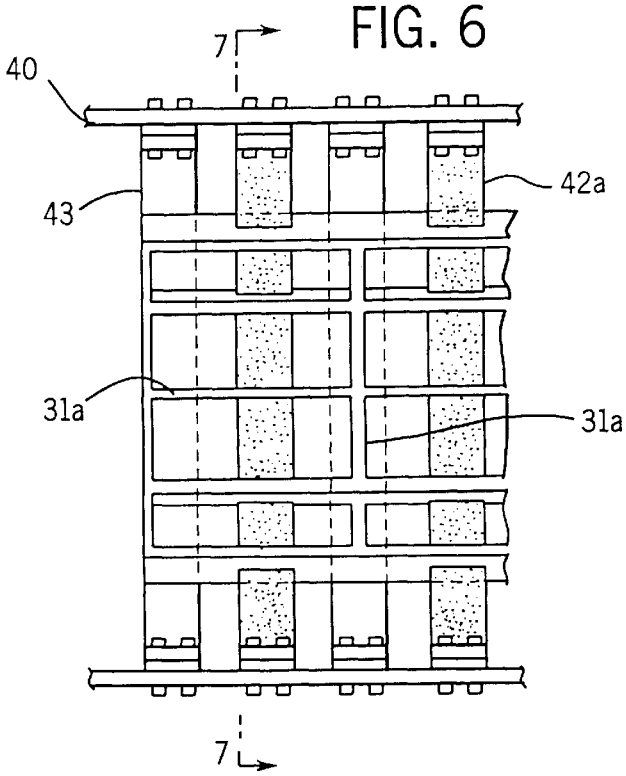
FIG. 6 is a plan and cut-away view of a basket system for an electroplating apparatus according to an alternative embodiment.

FIGS. 6 and 7 show an alternative embodiment of basket system 30*a* wherein basket compartments 32*a* are made of a plastic material (such as polypropylene according to a particularly preferred embodiment). Basket system 30*a* is supported by a combination of nonconducting weight-bearing support strips 43 (e.g. hangars) and conductive lead anodes 42*a*, both of which are bolted to rail 40. Support strips 43 cradle basket system 30*a*, passing under basket compartments 32*a*, to provide the primary supporting structure; lead anodes 42*a* pass through basket compartments and into electrical contact with nuggets 34*a*. Ultrasonic transducer elements 50*a* through 50*d* are also shown disposed beneath basket system 30 in FIG. 7. According to an alternative embodiment shown in FIG. 9, the apparatus employs a basket system 30 with two sets of basket compartments 32 disposed beneath the rotating cylinder. In the alternative embodiments shown in FIGS. 8 and 9, a single transducer element 50 is positioned beneath basket system 30.

Figure 11:
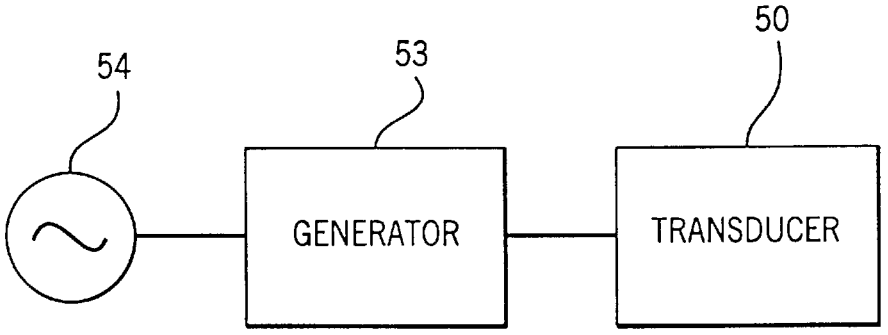
FIG. 11 is a schematic diagram of the ultrasonic transducer system.

Referring to FIG. 11, according to a preferred embodiment, the ultrasonic system includes an ultrasonic power generator 53 for transforming a commercial supply of electric power (e.g. typically provided at low frequency such as 60 Hz) to an ultrasonic frequency range (approximately 20 kHz), a transducer element 50 for converting the high frequency electrical energy provided by generator 53 into ultrasonic energy (i.e. acoustical energy) to be transmitted into and through the electrolytic fluid, and a low voltage direct current (DC) power supply 54 for powering generator 53 and transducer elements 50. As shown, ultrasonic transducer elements 50 are placed lengthwise under basket compartment 32 (or titanium tray) and have the surface from which the wave energy is transmitted oriented in a manner to promote an even exchanging of ions through electrolytic fluid F along the entire length of cylinder 20. Ultrasonic energy transmitted from the surface is also intended to agitate electrolytic fluid F and copper nuggets 34 thereby to "stir up" the copper sludge that tend to form (so that its constituents return to or tend to remain in the solution), according to phenomena employed in ultrasonic cleaning applications. In the preferred embodiment, the frequency and amplitude of the ultrasonic wave energy is maintained at a level (e.g. near 20 kHz) that tends to minimize the cavitation action that results from ultrasonic energy. Alternative embodiments, however, may operate at higher frequencies (e.g. above 20 kHz), where cavitation action tends to result, or may operate over a varying range of frequencies.

Figure 9:
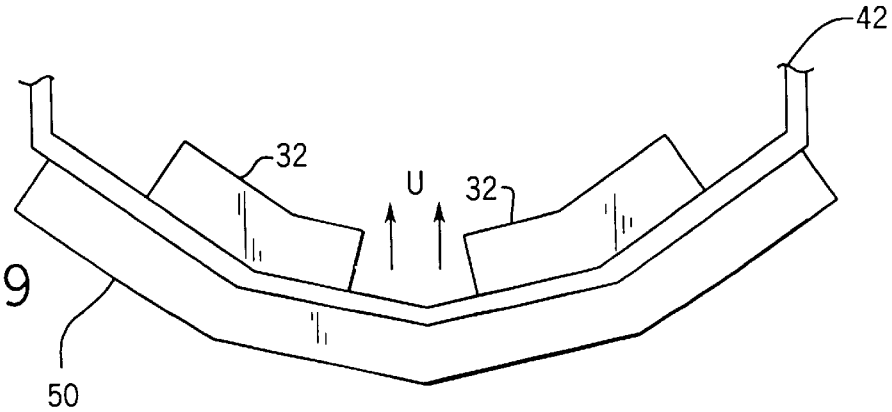
FIG. 9 is a sectional elevation view of a transducer assembly and a basket system for an electroplating apparatus according to an alternative embodiment.
Figure 10:
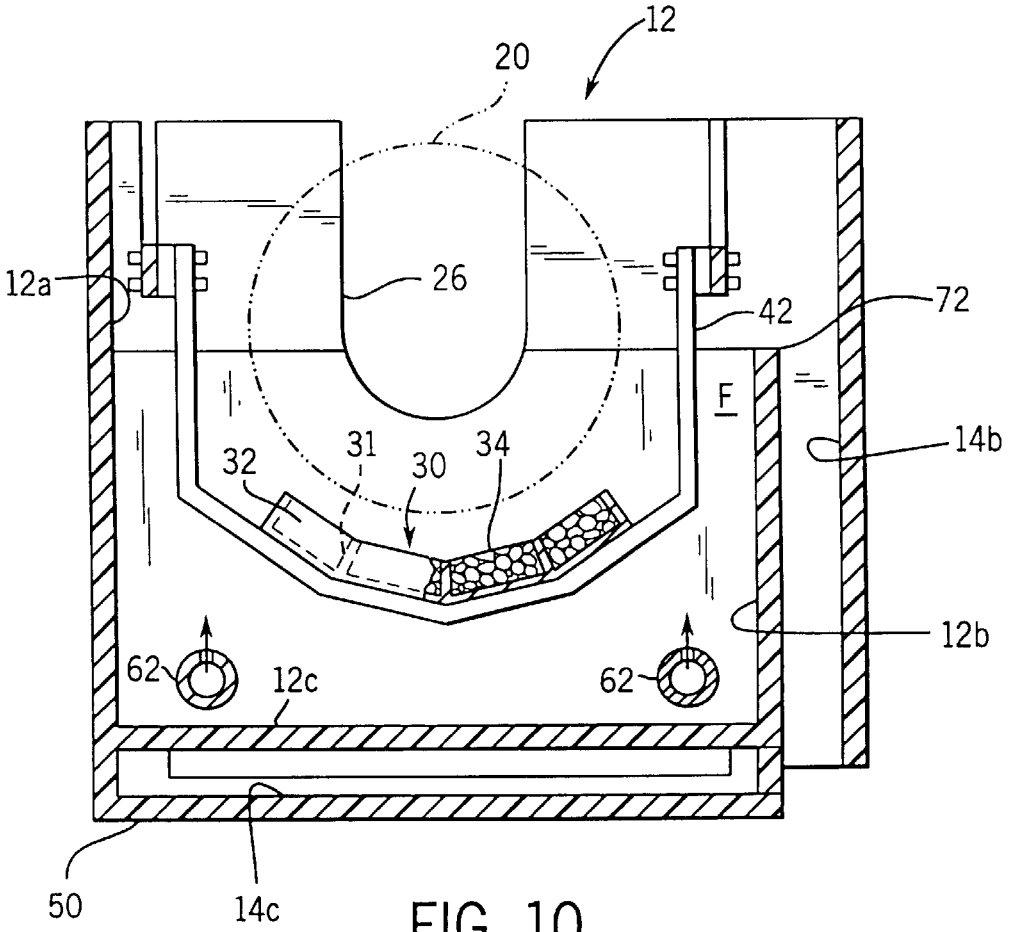
FIG. 10 is a sectional elevation view of a plating tank according to an alternative embodiment.

According to any preferred embodiment, the transducer elements efficiently convert electrical input energy from the generator into a mechanical (acoustical) output energy at the same (ultrasonic) frequency. The power generator is located apart from the plating tank, preferably shielded from the effects of the plating solution. The transducer elements can be generally of a ceramic or metallic material (or any other suitable material), preferably having a construction designed to withstand the effects of the plating solution in which they are immersed, and positioned to provide uniform energy (and thus uniform cavitation) throughout the basket system and rotogravure cylinder. (Exemplary transducer elements are described in the articles cited herein previously and incorporated by reference herein.) As shown in FIG. 9, a two basket system, ultrasonic energy (designated by reference letter U) will pass between the basket compartments to cylinder (not shown). In an alternative embodiment shown in FIG. 10, transducer element 50 is mounted in a separate compartment formed between plating tank 12 and holding tank 14 that does not contain the plating solution; according to this embodiment the transducer element (or transducer elements) does not need to be designed to withstand the effects of the plating solution. Alternative embodiments may employ various arrangements of transducer elements to optimize plating (and deplating) performance in view of design and environmental factors (such as the ultrasonic energy intensity, flow conditions, sizes, shapes and attenuation of the tank, basket system, cylinder, etc.).

The use of ultrasonic energy increases plating rates by facilitating rapid replenishing of metal ions in the cathode film during electroplating. The ultrasonic energy is also very beneficial in removing absorbed gases (such as hydrogen) and soil from the electrolytic fluid and the surfaces of other elements during the electroplating process. According to any particularly preferred embodiment, the transducer elements are arranged to provide ultrasonic energy at an intensity (e.g. frequency and amplitude) that provides for uniform and consistent agitation throughout the plating solution suitable for the particular arrangement of tank, cylinder and basket system. As contrasted to mechanical agitation, which may tend to leave "dead spots" in the plating tank with where there is little if any agitation, ultrasonic agitation may readily be transmitted in a uniform manner (according to the orientation of the array of transducer elements).

Ultrasonic agitation according to a preferred embodiment will further provide the advantage of preventing gas streaking and burning at high current density areas on the cylinder without causing uneven or rough deposits. As a result, the use of ultrasonic energy to introduce agitation into the plating tank produces a more uniform appearance and permits higher current density to be used without "burning" the highest current density areas of the cylinder like the edge of the cylinder. (Usually the critical area of burning or higher plating buildup is the edge of the cylinder.) (Ultrasonic energy also can be used in chrome tanks to increase the hardness of the chrome, to increase the grain structure of the chrome and to eliminate the microcracks in chrome.)

A further advantage of a preferred embodiment of the plating apparatus using ultrasonic energy is that it expands the range of parameters for the plating process such as current density, temperature, solution composition and general cleanliness. The surface of a plated cylinder that used ultrasonic energy according to a preferred embodiment will tend to have a much finer grain size and more uniform surface than a cylinder that used a conventional plating process. The plated surface hardness would typically increase (without any additive) by approximately 40 to 60 Vickers, evidencing a much finer grain structure. The use of ultrasonic energy in the plating process therefore allows a minimum or no polishing of the cylinder while increasing the speed of deoxidizing of the nuggets and basket.

ADDITIONAL ALTERNATIVE EMBODIMENTS—PART 1

According to additional alternative embodiments, the apparatus can be modified for plating or deplating a rotogravure cylinder with various metallic alloys or metals directly out of solution (i.e. without using metallic nuggets).

Figure 12:
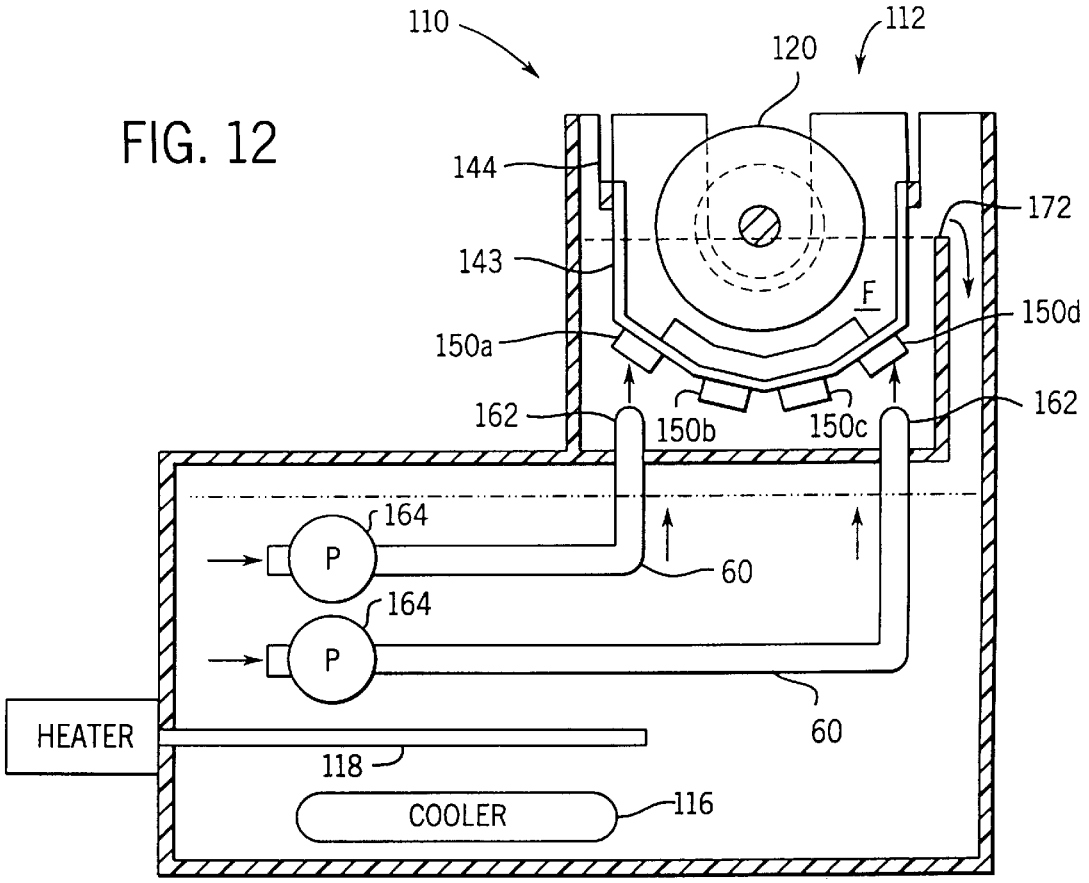
FIG. 12 is a sectional elevation view of a plating tank according to an additional alternative embodiment configured to plate a rotogravure cylinder directly out of a plating solution.

Apparatus 110 is shown in FIG. 12. Many of the same elements of other embodiments described herein (e.g. apparatus 10) are present in apparatus 110. However, apparatus 110 (shown without any baskets or associated elements) is adapted to plate cylinder 120 directly out of an electrolytic fluid a plating solution containing a plating metal or metal alloy in a plating solution indicated by reference letter F. According to this embodiment, cylinder 120 can be plated with any plating metal or metallic alloy. For example, cylinder 20*a* can be plated with chrome, zinc, nickel or other plating metal (including various alloys thereof) according to various processes known in the art.

Apparatus 110 includes a plating tank 112 of a type shown in FIG. 1 containing plating solution F at a level (indicated by reference letter L) regulated by the height of a weir 172. A rotogravure cylinder 120 to be plated (or deplated) is rotatably supported at its ends (e.g. upon an extending central shaft) to be submerged into the electrolytic fluid approximately one-half to one-third of the cylinder diameter. Cylinder 120 is rotatably supported at its ends by bearings within a journal, in which it is rotatably driven by a suitable powering device (not shown). Cylinder 120, shown in FIGS. 12 and 13 as one of a standard size (e.g. having a diameter of approximately 800 to 1500 mm); according to alternative embodiments cylinders of other diameters may be accommodated. According to any preferred alternative embodiment, the tank system and cylinder mounting and drive system are of a conventional arrangement known to those of ordinary skill in the art of rotogravure cylinder plating. The electrolytic fluid is itself of a composition known to those of ordinary skill in the art of electroplating.

Conductive curved anode strips are electrically connected to current carrying rails 144 and mounted in plating tank to make electrical contact with the plating solution (electrolytic fluid F). For plating the cylinder, the rails are connected to an anode side of a plating power supply (e.g. a current source of known design) and the cylinder is connected to a cathode side of the power supply; for de-plating, the anode-cathode connections are reversed. When the cylinder is printed out (i.e. after having been plated and etched), it is returned to the plating apparatus and deplated so as to return the plating metal to the solution. According to alternative embodiments, other conventional arrangements for effecting the electrical connections to the plating solution (electrolytic fluid) and the cylinder may be employed.

As shown in FIG. 2, a mounting structure 143 (oriented similarly to the anode strips) is mounted to (but not electrically connected to) rails 144. (Or it alternatively can be mounted to the walls of plating tank 112.) Disposed lengthwise along the bottom surface of mounting structure 143 (e.g. bonded or securely mounted thereto) are ultrasonic transducer elements 150. Transducer elements 150 (shown as four elements 150*a* through 150*d*) are electrically coupled to a control system (shown schematically in FIG. 10) and are provided to introduce ultrasonic wave energy into plating tank 112. Transducer elements 150 can be of a type disclosed herein or of any other suitable type known in the art. According to a particularly preferred embodiment, the transducer elements are designed to provide for operation in a frequency range of 15 to 30 kHz (cycles), although other ultrasonic frequency ranges (above 40 kHz and beyond) may be employed. Transducer elements 150 are configured and positioned to assist with the plating process (e.g. to facilitate consistency of ion migration through the electrolytic fluid), and to prevent any fouling buildup on the various elements of apparatus 110.

As shown in FIG. 12, according to a preferred alternative embodiment, the electrolytic fluid supply system functions as a closed circuit system. (As is apparent, this system is similar in structure and operation to other embodiments previously disclosed.) A supply of electrolytic fluid F is provided into plating tank 112 by at least one spray bar 162 (two are shown), which consists of a section of pipe or tube extending laterally along or near the bottom of plating tank 112. Each spray bar 162 has a series of apertures along its length (similar to as shown at least partially in FIG. 2) that provide for a constant and relatively well-dispersed flow of electrolytic fluid into plating tank 112 from a holding tank 114 (e.g. a reservoir). A holding tank 114 is disposed beneath plating tank 112 so as to capture any flow of electrolytic fluid travelling over weir 172 in plating tank 112. (Electrolytic fluid F is maintained at its own level in holding tank 114.)

Electrolytic fluid may build up heat and increase in temperature over time during the plating (or deplating) process and therefore holding tank 114 is equipped with a fluid cooling system 116 (e.g. a suitable heat exchanger for such fluid of a type known in the art). Likewise, electrolytic fluid may need to be heated from an ambient temperature to a higher temperature at the outset of the plating process and therefore holding tank 114 is also equipped with a fluid heating system 118 (e.g. a suitable heat exchanger for such fluid of a type known in the art). The temperature regulating system for the plating solution can be coupled to an automatic control system that operates from information obtained by temperature sensors in or near one or both tanks, and to control other parameters that may be monitored during the process, according to known arrangements. Before the electroplating process begins, the ultrasonic system can be energized to provide for agitation of electrolytic fluid and for cleaning of the system to provide for better contact and plating performance.

A pair of supply pipes 160 feed spray bars 162 with a supply flow of electrolytic fluid F. Supply pipes 160 each are coupled to a circulation pump 164 (configured and operated according to a known arrangement that may or may not have a filter). Circulation pumps 164 draw electrolytic fluid F from holding tank 114 into inlets in each of supply pipes 160 and force it under pressure into spray bars 162 where it is reintroduced through apertures into plating tank 112 for the electroplating process. Each of spray bars 162 extends along the bottom of plating tank 112, rising horizontally from holding tank 114 and turning at an elbow to run horizontally along and beneath mounting structure 143. According to alternative embodiments, the apparatus could include one pump coupled to either a single spray bar or a spray bar manifold system, or any other combination of elements that provide for the suitable supply of electrolytic fluid into the plating tank.

Figure 13:
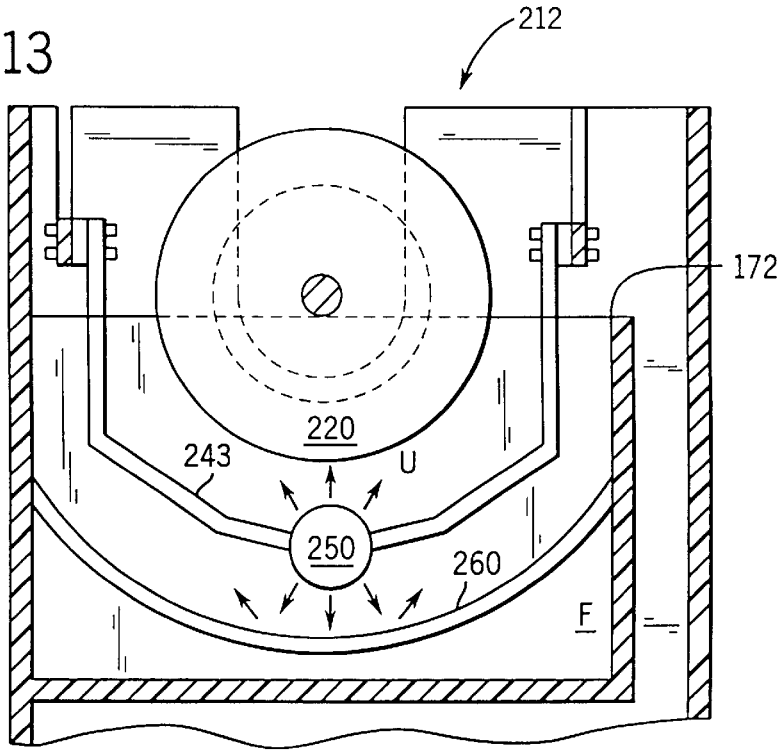
FIG. 13 is a sectional and partial elevation view of a plating tank according to an additional alternative embodiment configured to plate a rotogravure cylinder directly out of a plating solution.

An alternative embodiment is shown partially in FIG. 13 (certain elements of the apparatus are not shown), wherein the apparatus 210 employs an ultrasonic transducer element 250 that is cylindrical in shape (having a diameter of about 70 mm in a particularly preferred embodiment). Transducer element 250 is shown mounted within plating tank 212 by a mounting structure 243 (for example, as mounting structure 143 shown in FIG. 12). According to alternative embodiments, a mounting structure 243 integrated with the anode strips can be employed (compare FIG. 3). As shown, one transducer element 250 is mounted underneath rotating cylinder 220 by mounting structure 243 (at or near the level of the curved anode strips below cylinder 220 according to the preferred embodiment). One or more such transducer elements can be used according to alternative embodiments, for example, mounted in a spaced-apart arrangement along the mounting structure beneath cylinder 220. Underneath transducer element 250 is placed a reflector 260 having a highly polished reflective surface shown mounted to side walls of plating tank 212.

Reflector 260 is shown in the preferred embodiment as being of an integral unit having an arcuate shape, and extends substantially along the entire length of cylinder 220 (as does transducer element 250). Alternatively, the reflector can be provided with any other suitable shape (such as parabolic or flat or multi-faceted) or in segments. Transducer element 250 when energized will transmit wave energy (shown partially by reference letter U) in a substantially radial pattern through the plating solution, including toward cylinder 220 and against reflector 260 which will reflect the wave energy back to cylinder 220 and related structures (such as the anode strips). The direct and reflected ultrasonic wave energy is intended to keep the surfaces of the cylinder and related structures free of fouling buildup and to facilitate the plating process.

According to any preferred embodiment, ultrasonic wave energy can be used in the plating (and deplating) of various metals and metal alloys to the cylinder, as in chrome plating and also for plating alloys of zinc, nickel, etc. The ultrasonic system according any particularly preferred alternative embodiment will be capable of generating between two to six kilowatts of power, the system will provide ultrasonic energy at a frequency between 10 to 40 kHz (cycles per second).

Figure 14:
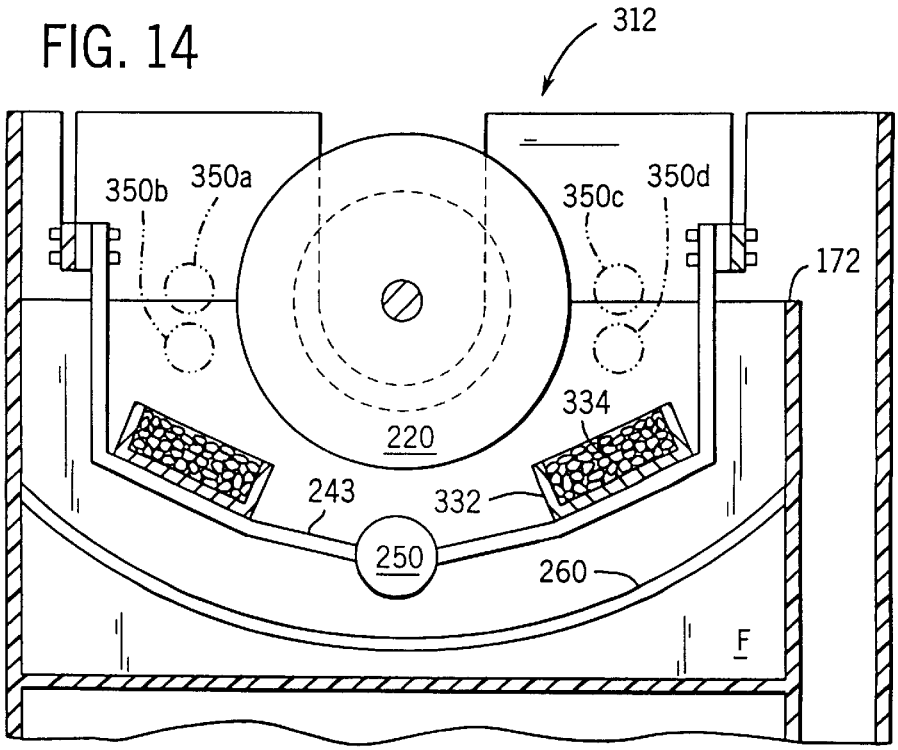
FIG. 14 is a sectional and partial elevation view of a plating tank according to an additional alternative embodiment.

As shown in FIG. 14, in alternative embodiments (similar to that shown in FIG. 13), other configurations of transducer elements (e.g. cylindrical in shape with a circular profile) can be employed. For example, four transducer elements 350*a* through 350*d* (shown in phantom lines) can be mounted in plating tank 312 at the sides of cylinder 220 (by a mounting structure fixed to the walls or base of the plating tank or some other suitable structure, not shown). According to an alternative embodiment, two transducer elements (e.g. 350*b* and 350*d*) can be used instead of four. (Transducer element 250 mounted by structure 243 and reflector 260 are also shown.) As is evident, a wide variety of transducer configurations can be made within the scope of the present invention, with any preferred embodiment including at least one transducer element positioned in or near the plating tank so that the beneficial effect of ultrasonic energy can be realized during the electroplating process. As FIG. 14 shows, such arrangements of transducer elements 350*a* through 350*d* (and 250) can also be employed in alternative embodiments used in connection with an electroplating apparatus that uses metal nuggets 334 maintained in basket compartments 332 (similar in arrangement to other embodiments described herein).

ADDITIONAL ALTERNATIVE EMBODIMENTS—PART 2

According to additional alternative embodiments, the apparatus can be modified for plating a rotogravure cylinder with various metallic alloys or metals (such as copper using metallic nuggets or chrome or zinc directly out of solution) to produce a uniform and consistent grain structure on the surface of the plated cylinder. Apparatus 410 is shown in FIGS. 17 through 26. Many of the same elements of other embodiments described herein (e.g. apparatus 10, etc.) are present in apparatus 410, or can be included in the apparatus according to various alternative embodiments.

Figure 17:
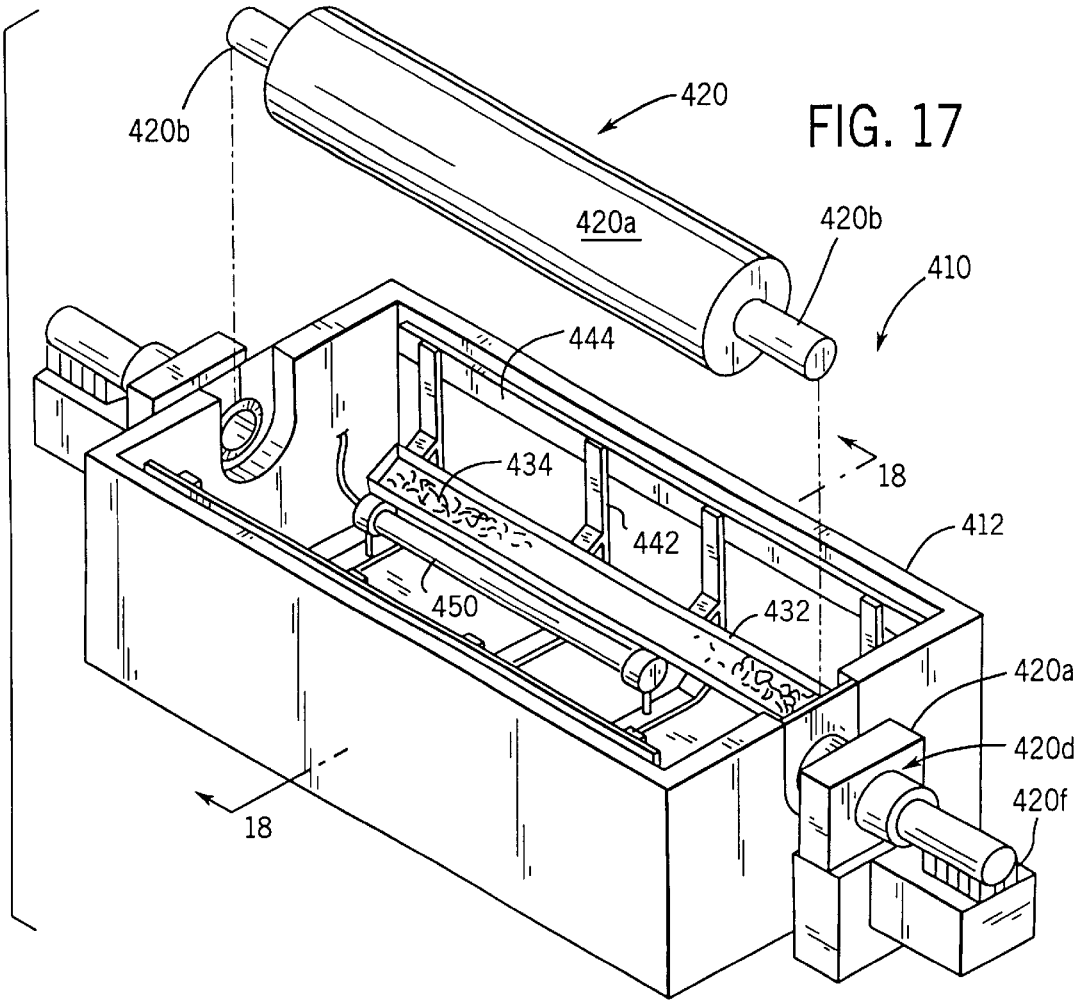
FIG. 17 is a partially exploded perspective view of a plating tank (with a rotogravure cylinder) according to an alternative embodiment of the present invention.
Figure 18:
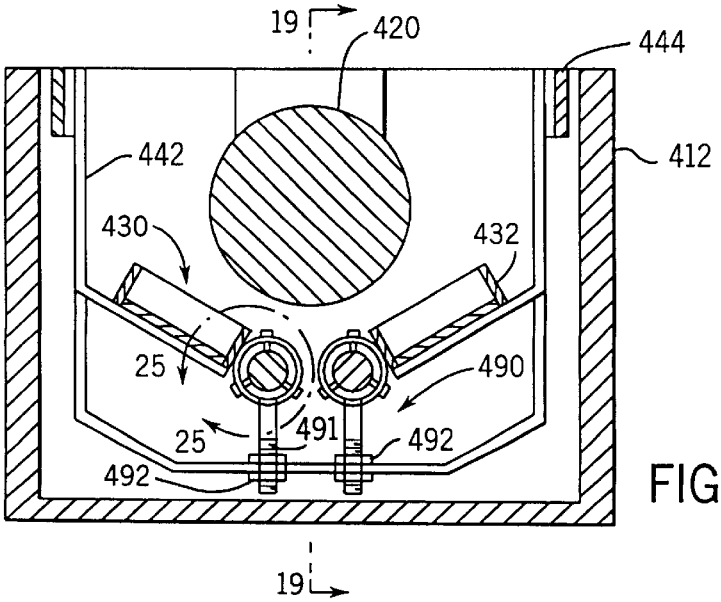
FIGS. 18 and 18A are sectional end and elevation views of the plating tank of FIG. 17.
Figure 19:
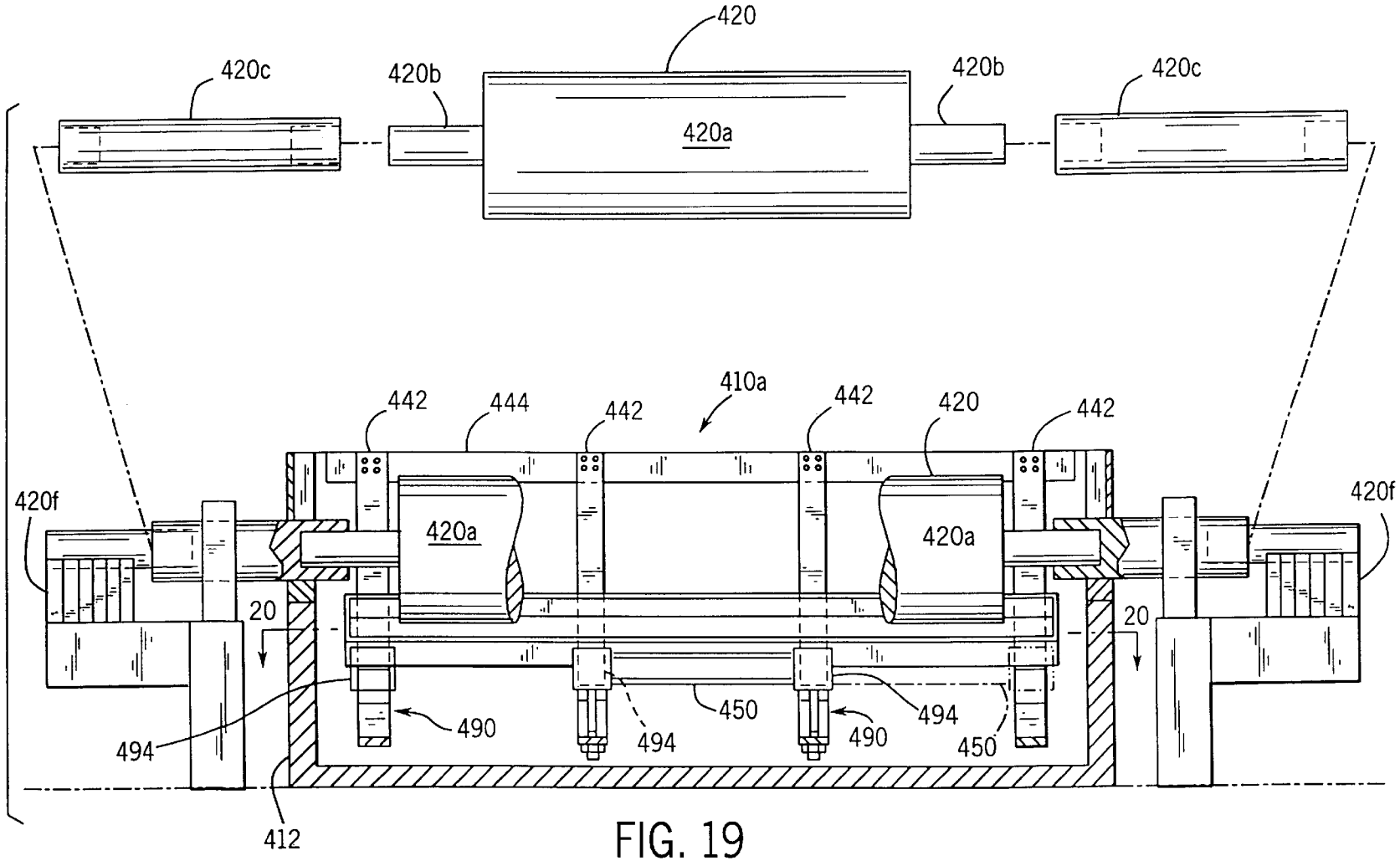
FIG. 19 is a sectional side and elevation view of the plating tank (with a rotogravure cylinder) of FIG. 17.
Figure 23:
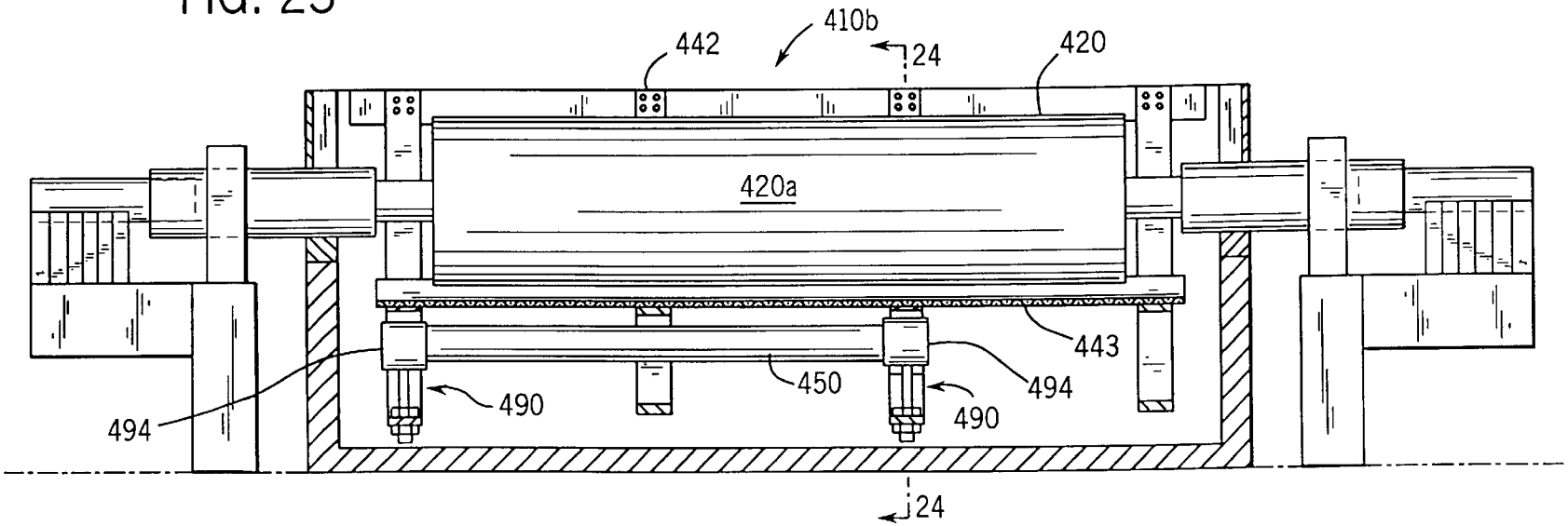
FIG. 23 is a sectional side and elevation view of a plating tank (with a rotogravure cylinder) according to an alternative embodiment of the present invention.

In FIGS. 17 through 19, apparatus 410*a* is shown with basket compartments 432 and associated elements to plate a rotogravure cylinder 420 from copper nuggets 434 in a plating solution (indicated by reference letter F in other FIGURES). In FIGS. 23 and 24, apparatus 410*b* (shown without any baskets or associated elements) is adapted to plate cylinder 420 directly out of an electrolytic fluid (a plating solution containing a plating metal or metal alloy in a plating solution indicated by reference letter F in other FIGURES). According to this embodiment, a cylinder 420 can be plated with any plating metal or metallic alloy. For example, the cylinder can be plated with chromium (chrome), zinc, nickel or other plating metal (including various alloys thereof) according to various processes known in the art.

Apparatus 410 includes a plating tank 412 of a type shown in FIG. 1 containing plating solution F at a level (indicated by reference letter L in other FIGURES). (The holding tank which can be positioned in any suitable location near the plating tank is not shown in these FIGURES.) Rotogravure cylinder 420 to be plated is rotatably supported at its ends (e.g. upon an extending central shaft) to be submerged into the electrolytic fluid approximately one-half to one-third of the cylinder diameter. Cylinder 420 is rotatably supported at its ends by bearings within a journal, in which it is rotatably driven by a suitable powering device (not shown). According to any preferred alternative embodiment, the tank system and cylinder mounting and drive system are of a conventional arrangement known to those of ordinary skill in the art of rotogravure cylinder plating. (Plating stations that may be adapted to incorporate the various embodiments of the present invention are commercially available, for example, from R. Martin AG of Terwil, Switzerland.) The electrolytic fluid is itself of a composition known to those of ordinary skill in the art of electroplating.

As shown in FIGS. 17 and 23, cylinder 420 has a cylindrical face surface 420*a* and opposing axial ends 420*b* (having a generally cylindrical shape). Ends 420*b* of cylinder 420 are installed into the apparatus according to a conventional arrangement to allow for axial rotation of the cylinder during the plating process. The cylinder assembly is shown generally in FIGS. 19 and 23. As shown schematically, each end 420*b* of cylinder 420 is mechanically coupled (e.g. using a chuck or like holding device) to an adapter 420*c* (also allowing for size differences in cylinders) which is retained within a bearing 420*d* (shown mounted to a bearing support 420*e*) for rotational movement about the axis of cylinder (e.g. imparted by a motor, not shown). Brushes 420*f* provide an electrical connection (i.e. as cathode) to cylinder 420.

Figure 15:
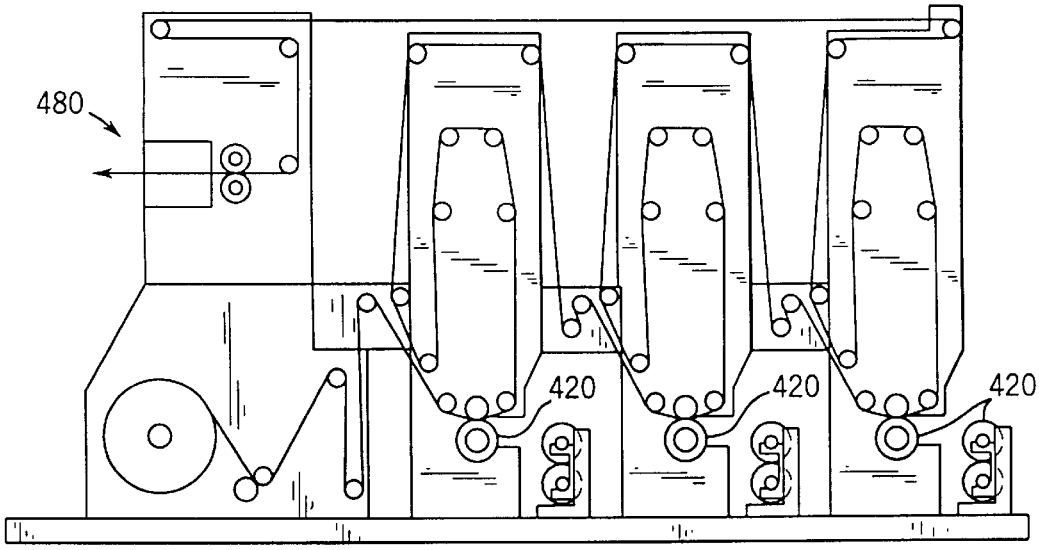
FIG. 15 is a schematic elevation view of a conventional printing system.
Figure 16:
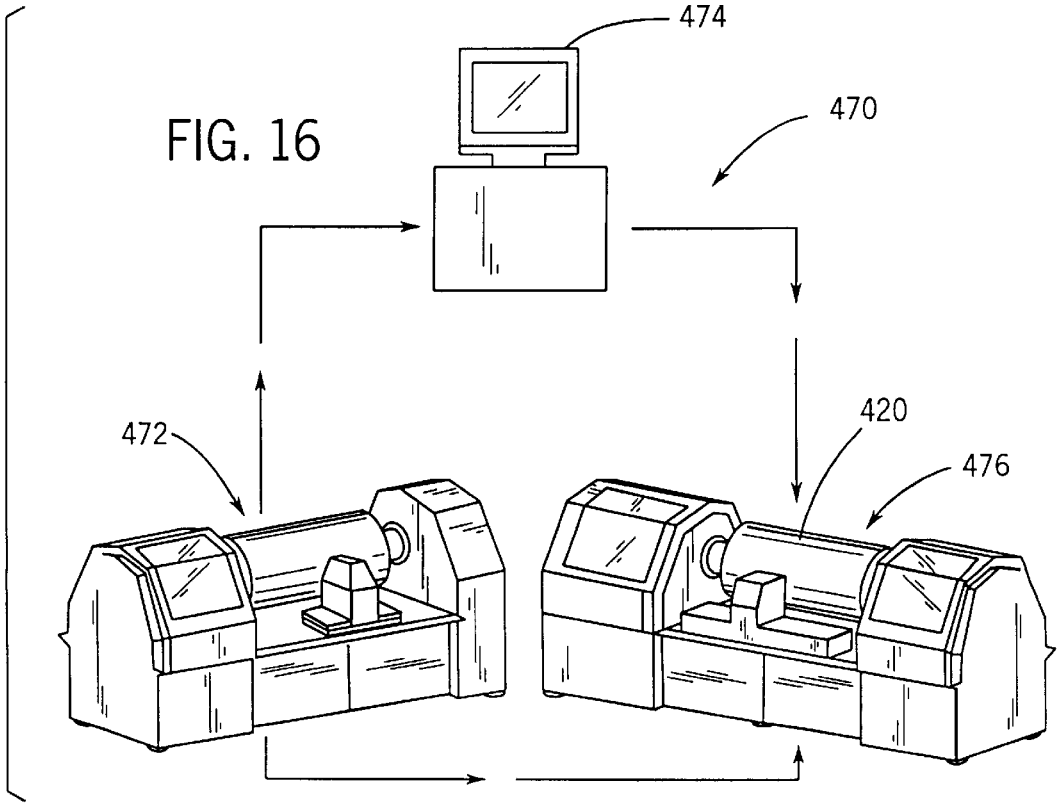
FIG. 16 is a schematic perspective view of a system for engraving an image on a rotogravure cylinder.

According to an exemplary embodiment, the cylinder includes a steel (e.g. 99 percent steel) base surface, as is conventional. Exemplary cylinders are commonly available (from commercial suppliers) in a variety of sizes, which can be plated according to the method of the present invention. Such cylinders after plating and engraving are used for printing packaging or publications (e.g. magazines); exemplary cylinder surface diameters and lengths (i.e. surface area to be plated, engraved and printed out) will suit particular applications. Following the plating of the cylinder, the surface can be polished, then engraved with an image, for example using engraving system 470 as shown schematically in FIG. 16, including a scanner 472, computer-based controller 474 and an engraver 476. Such systems are commercially available, for example, from Ohio Electronic Engravers, Inc. of Dayton, Ohio (Model No. M820). The cylinder can be cleaned (and chrome-plated) and then printed out (according to processes known to those in the art who may review this disclosure), for example, onto a roll or web of paper using a printing system 480 (including cylinders 420) as shown schematically in FIG. 15. When use of the cylinder in the printing operation is completed, the image is removed from the surface of the cylinder (e.g. stripped off if engraved on a Ballard shell or cut off if engraved on a base copper layer). The cylinder can be cleaned and deoxidized, then replated (e.g. with base copper) and engraved for reuse. (Other materials may be similarly plated or engraved and printed on the cylinder by alternative embodiments, such as chrome or zinc.)

As has been described, the plating process is enhanced by the introduction of ultrasonic wave energy into the plating tank. An ultrasonic generator converts a supply of alternating current (AC) power (e.g. at 50 to 60 Hz) into a frequency corresponding to the frequency of the ultrasonic transducer system (oscillator); the usual frequency is between 15 or 20 kHz and 40 kHz. The energy to the transducer (from the generator or oscillator) is supplied by means of a protected connection (e.g. a cable) transmitting energy at the appropriate frequency. The transducer element converts the electrical energy into ultrasonic energy, which is introduced into the plating solution as vibration (at ultrasonic frequency). The vibration causes (within the plating solution) an effect called cavitation, producing bubbles in the solution which collapse upon contact with surfaces (such as the plated cylinder). The greater amount of ultrasonic wave energy introduced into the plating tank, the greater this effect.

Figure 22:
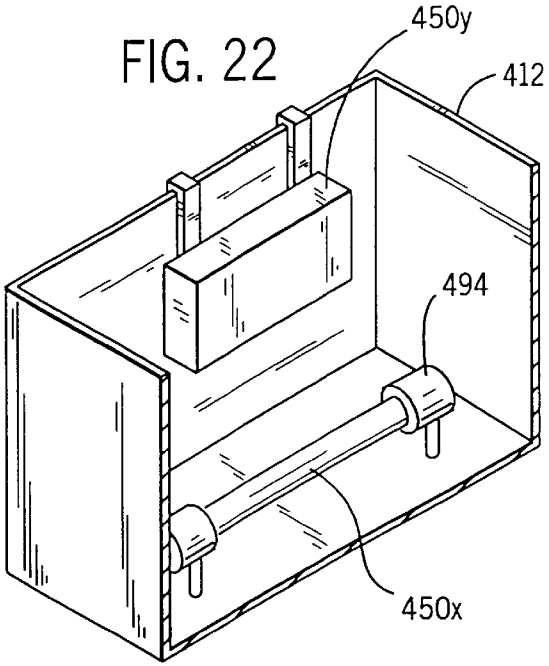
FIG. 22 is a schematic sectional perspective view of a plating tank showing alternative arrangements of ultrasonic transducer elements.

Shown schematically in FIG. 22 are two types of ultrasonic transducer elements, cylindrical element 450*x* and rectangular element 450*y*. In preferred embodiments, as shown in FIGS. 19 and 23, an arrangement of cylindrical transducer elements 450 is used. The configuration of transducer element 450 (without the protective cover) according to a particularly preferred embodiment is shown in FIG. 26. Transducer element 450 has end portions 450*b* and a central portion 450*a*; power is supplied at one of end portions 450*b* through an electrical connector 451 (shown as a cable which is coupled to the ultrasonic generator, not shown in FIG. 26). In an exemplary embodiment, the cylindrical transducer element has an overall length of approximately 1131 mm, a diameter of approximately 50 mm at its central portion and a diameter of approximately 70 mm at its end portions; such a transducer element provides approximately 1.5 kW of energy into the plating tank. (A transducer element of an overall length of approximately 1320 mm will provide approximately 2.0 kW; a transducer element of an overall length of 438 mm will provide approximately 0.6 kW). In the preferred embodiment, each transducer element used in the apparatus is a high capacity (free-swinging) element, and provides a uniform sound field, enabling a high sound density. (Ultrasonic wave energy disperses radially from the axis of the transducer element, as shown in FIG. 13.) The transducer element is of a very compact (space-saving) design. As installed, it provides for easy replacement. According to particularly preferred embodiments, as installed, it is of a high durability (e.g. resistant to the effects of the plating solution). According to a particularly preferred embodiment, the system of ultrasonic transducer elements (and associated equipment) is provided by Tittgemeyer Engineering GmbH of Amsberg, Germany. Ultrasonic transducer elements of varying shapes, sizes (lengths and diameters) and power, and associated ultrasonic generators are available from a variety of other sources and suppliers.

Figure 20:
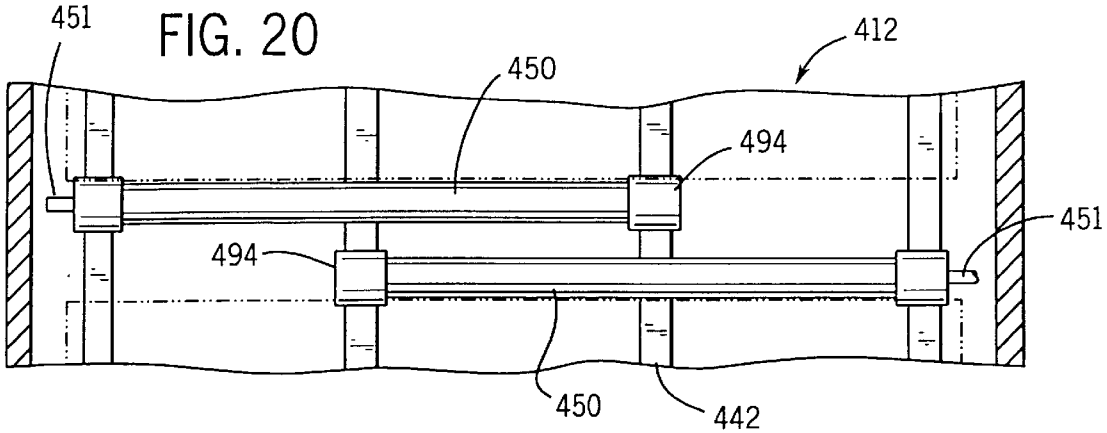
FIGS. 20 and 21 are plan views of exemplary arrangements of ultrasonic transducer elements within a plating tank according to alternative embodiments of the present invention.
Figure 21:
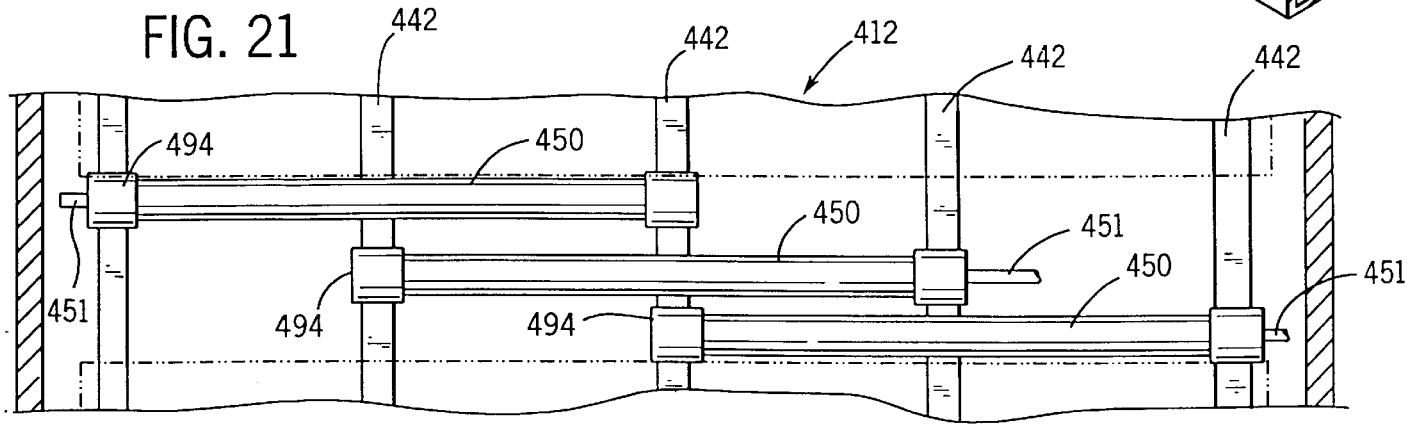

The apparatus can be constructed to accommodate rotogravure cylinders of a variety of sizes (e.g. smaller with a face length of 40 to 50 inches as used for packaging or larger, 72 to 148 inches as used for publications). The cylinder may have a standard diameter (of approximately 800 to 1500 mm) or, according to alternative embodiments, other diameters may be accommodated. As is evident from this disclosure, comparing FIGS. 18, 20 and 21, the ultrasonic transducer elements can readily be installed within the plating tank in a suitable manner to introduce ultrasonic wave energy to facilitate the plating process. For example, two, three, or more ultrasonic transducer elements can be installed in a staggered or offset pattern to ensure coverage of (i.e. transmission of ultrasonic wave energy to) and along the entire length of the surface of the cylinder, as shown in FIGS. 20 and 21. According to an exemplary embodiment, each transducer element introduces about 1.5 to 2.0 kW of energy into the plating tank; if 6.0 kW of energy is to be introduced into the plating tank, three or four transducer elements can be installed, for example. For obtaining desirable results in the plating of smaller cylinders, two transducer elements may be used (3.0 to 4.0 kW); for longer cylinders, three or more transducer elements may be used (4.5 to 6.0 kW or more). According to a preferred embodiment, the amount of power to be applied by the transducer elements can be adjusted from 20 to 100 percent at the generator (oscillator) of the ultrasonic system. To optimize performance in a given application, other arrangements are possible using other transducer element combinations and power adjustment capability at the ultrasonic generator (e.g. 20 to 100 percent power).

Figure 18A:
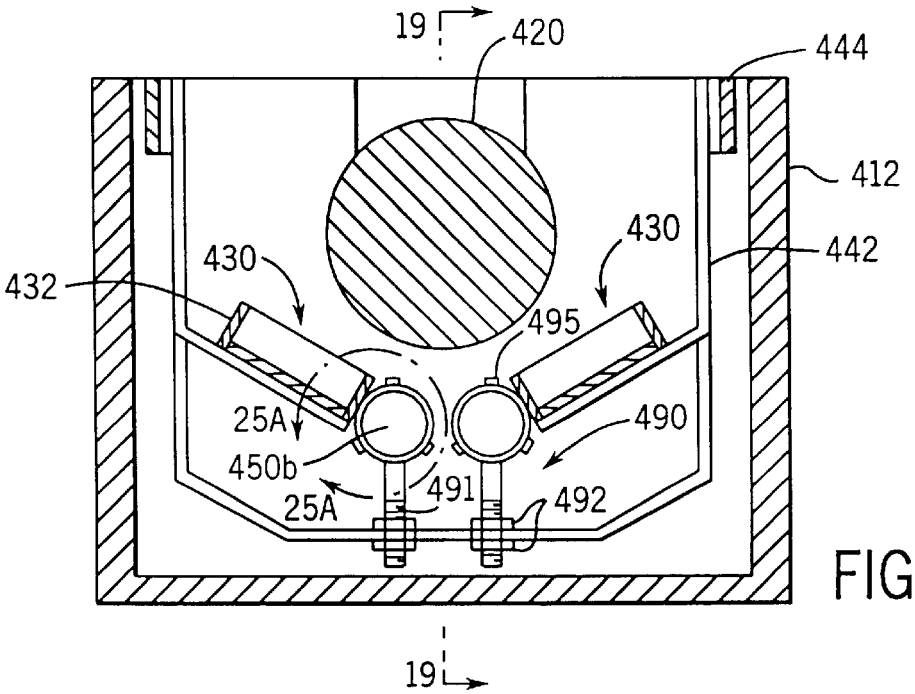
Figure 25A:
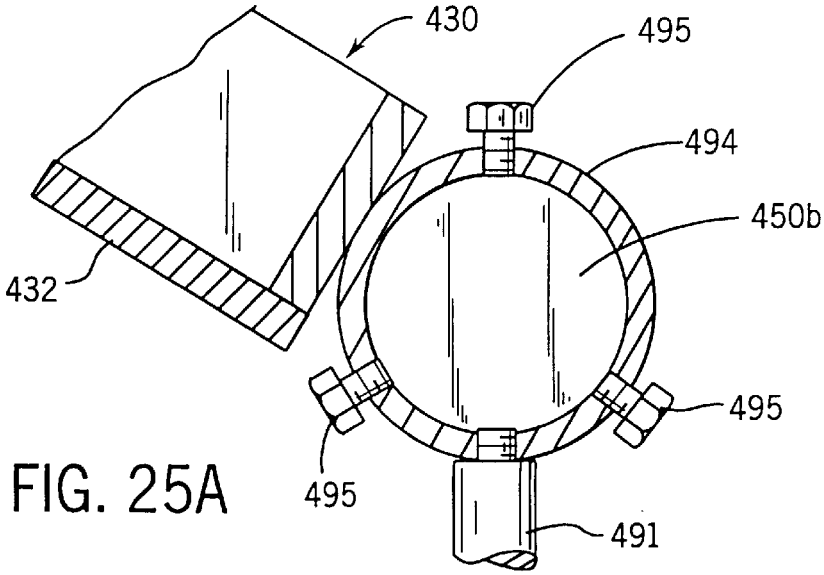

The installation of the ultrasonic transducer elements of the apparatus according to a preferred embodiment is shown in FIGS. 18 and 24, and the other associated FIGURES. In FIGS. 18 and 18A, showing an apparatus adapted to plate copper from copper nuggets contained in basket compartments 432, transducer elements 450 are shown mounted to conductors shown as anode strips 442 (although another mounting structure could be used) which are coupled to current-carrying rails 444. In FIG. 24, showing an apparatus adapted to plate chrome or zinc or other metals directly from solution, a similar arrangement may be used (although a mounting structure distinct from the anode strips may be used); this apparatus includes an anode (mesh or expanded material) 443 positioned between transducer elements 450 and cylinder 420. The mounting arrangement includes supports 490 for the transducer elements. According to a preferred embodiment, support 490 may include an at least partially threaded rod 491 held at its base by two nuts 492 to anode strip 442 (or in other embodiments the mounting structure); a collar 494 is mounted to (threaded onto) rod 491. End 450*b* of transducer element 450 is fitted within collar 494 and secured therein by at least one retaining screw 495 (see FIGS. 25 and 25A). (FIGS. 18A and 25A show an alternative embodiment of the mounting arrangement with a different collar fit.) The collar is preferably made of an electrically isolated plastic material; the transducer element is preferably covered with a protective cover 498 of an electrically isolated plastic material (such as a shrink-wrap tube of sufficient length). In each case, the objective is to prevent the build-up of plating material on the structures and withstand the effects of the plating solution. Other elements of the mounting arrangement are preferably treated with a resistant coating or made from a resistant material (or covered with electrical tape or the like) for isolation and also to withstand the effects of immersion in the plating solution. The supports can be provided in various shapes and lengths, in alternate locations (e.g. mounted to the wall or floor of the plating tank or to a supplemental structure), or with an adjustment capability, that allows the transducer elements to be positioned (at least vertically) in a functionally advantageous position within the plating tank. According to alternative embodiments, other mounting or fastening arrangements, for example, that withstand mechanical vibration and associated effects (e.g. loosening or fatigue), can be used.

FIGS. 20 and 21 show particular alternative arrangements of transducer elements intended to provide suitable "coverage" (i.e. generally uniform distribution) of ultrasonic wave energy along the length of the rotogravure cylinder (not shown), notwithstanding differences in cylinder length. In FIG. 20, a cylinder of intermediate length is accommodated; in FIG. 21, a longer cylinder is accommodated. Other arrangements can be provided to accomplish the goal of uniformity of distribution of ultrasonic wave energy to and along the cylinder. For example, transducer elements of a like type are available in other lengths, and may be used. In any preferred embodiment, however, the transducer elements should be arranged to provide for uniformity, notwithstanding the size or shape of the transducer elements. The amount of ultrasonic wave energy that is introduced into the plating tank to achieve the desired, consistent grain structure on the plated surface of the cylinder is roughly proportional to the plated surface area. For example, a 56-inch cylinder of approximately 10 inches in diameter uses approximately 3.0 kW of ultrasonic energy. Smaller surface areas require less energy; larger require more, roughly in this proportion. Ultrasonic wave energy requirements can be adapted to suit the application and will guide the arrangement of the transducer elements.

According to any preferred embodiment of the present invention, the rotogravure cylinder is provided with a plated surface having a consistent, even grain structure. Consistency of grain structure (and therefore of engraved "cells") within the plated surface of the rotogravure cylinder provides for higher quality of engraving and enhanced quality of rotogravure printing. Preferably, plating consistency is achieved in all dimensions, across and around the plated surface. The process of preparing the rotogravure cylinder for printing according to the various embodiments of the present invention is intended to provide the desired consistent grain structure for a variety of plated materials (i.e. copper, chrome, zinc, or the like). The process can be performed using apparatus as described in this disclosure or alternatively any other suitable apparatus adapted to practice the disclosed method.

In arranging or sequencing a series of steps (e.g. treatment) relating to the plating of the cylinder (i.e. the surface) according to preferred embodiments, various options are available. The cylinder is cleaned (a step that is regularly conducted after other method steps to ensure a quality plated surface for printing). A treatment of nickel or cyanide copper may be applied to the cylinder to facilitate plating. Alternatively base copper may be plated directly onto the cylinder. (According to the preferred embodiments of the present invention, copper may be plated directly onto the steel cylinder without the need for a special treatment.) According to exemplary embodiments, the base copper will have a thickness in a range between approximately 0.010 and 0.040 inches (though other thicknesses may be plated). If a Ballard shell is to be plated onto the cylinder, a separating solution will be applied to the base copper layer. The Ballard shell (if created) will preferably have a minimum thickness of approximately 0.003 inches or so (e.g. 0.0027 to over 0.004 inches).

According to the preferred embodiments, plating can be conducted in accordance with the same basic range of values of process parameters as for plating by convention methods (i.e. without using ultrasonic energy). The plating process according to the preferred embodiments is intended to produce a more uniform, consistent grain structure of the plated material as well as to speed the plating by allowing more energy (i.e. a higher current density on the plated surface) to be applied during plating without adverse effects. According to exemplary embodiments, copper can be plated with a current density in a range of approximately 1 to 3 amperes per square inch (as compared with 0.8 to 1.2 amperes per square inch as an example for a typical conventional process); chrome can be plated with a current density in a range of approximately 5 to 12 amperes per square inch (as compared with 5 to 7 amperes per square inch as an example for a typical conventional process). As a result, in an exemplary embodiment, plating may be accomplished as much as 40 to 50 percent faster, or an increased thickness of plated material can be achieved in a given time period. For example, all other parameters being maintained constant, if a conventional system plates a Ballard shell of 0.0027 inches onto the cylinder in approximately 30 minutes without using ultrasonic energy, by using ultrasonic energy according to a preferred embodiment, after 30 minutes a Ballard shell of 0.004 inches in thickness would be plated onto the cylinder.

According to an exemplary embodiment for plating with copper (e.g. from copper nuggets), the plating solution is maintained at a temperature of approximately 25 to 35° C. (preferably 30 to 32° C.) with a concentration of 210 to 230 grams/liter of copper sulfate (preferably 220 grams/liter) and 50 to 70 grams/liter of sulfuric acid (preferably 60 grams/liter); ultrasonic energy (i.e. power) can be applied in a range of 1.5 to 6 kVA. According to a particularly preferred embodiment for plating with chrome (e.g. directly out of solution), the plating solution is maintained at a temperature of approximately 55 to 65° C. with an initial concentration of 120 to 250 grams/liter of chromic acid and 1.2 to 2.5 grams/liter of sulfuric acid; ultrasonic energy (i.e. power) can be applied in a range of 1.5 to 6.0 kVA. As is apparent to those of skill in the art who review this disclosure, the values of process parameters may be adjusted as necessary to provide a plated surface having desired characteristics. According to alternative embodiments, these ranges may be expanded further, using the advantages of ultrasonic energy.

Figure 28:
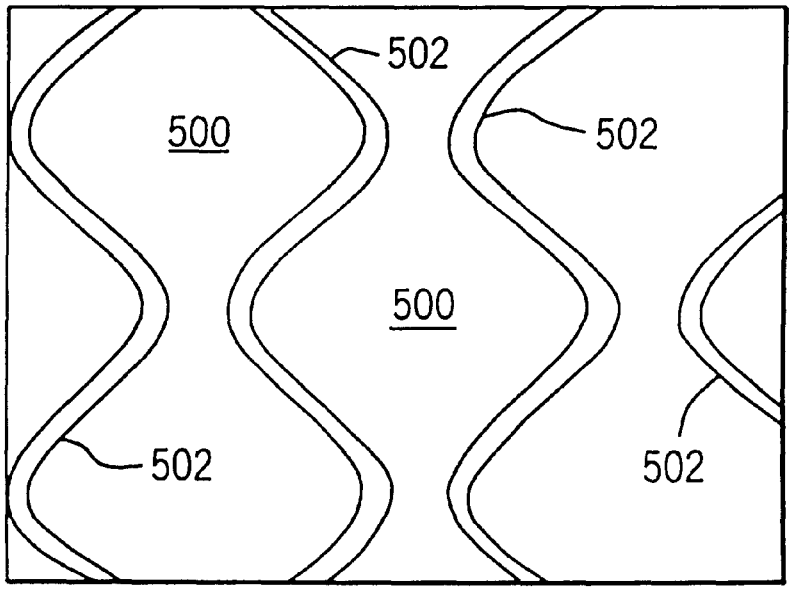
FIG. 28 is a schematic view of the grain structure of the rotogravure cylinder plated according to a preferred embodiment of the present invention.
Figure 30:
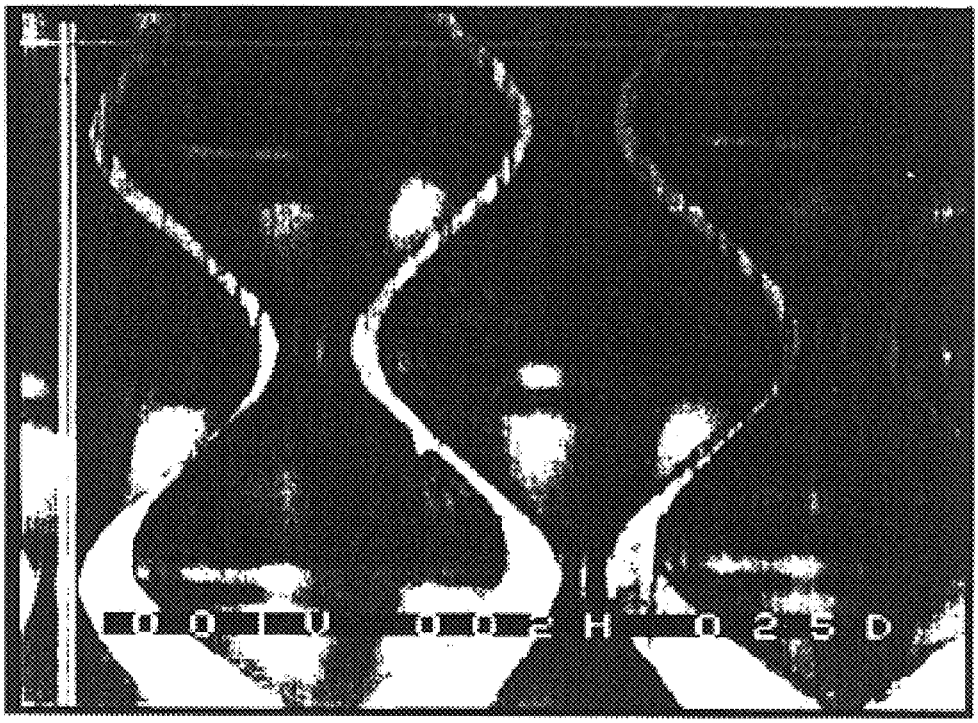
FIG. 30 is a photomicrograph of the surface of a rotogravure cylinder intended to correspond to FIG. 28.

In comparison to conventional methods (e.g. without using ultrasonic energy), the rotogravure cylinder plated according to any preferred embodiment of the present invention will provide a surface better suited for subsequent engraving and printing, as shown in FIGS. 28 and 30. The plated surface of the cylinder will be characterized by a hardness similar to that obtained by conventional methods, but the grain structure (i.e. size) will be more consistent across and along the surface (i.e. both around the circumference and along the axial length of the cylinder), by example (for copper plating) varying approximately 1 to 2 percent (with ultrasonic) in comparison to approximately 4 to 10 percent (without ultrasonic). (According to other exemplary embodiments, the plated surface hardness may increase 20 to 30 Vickers.)

Figure 27:
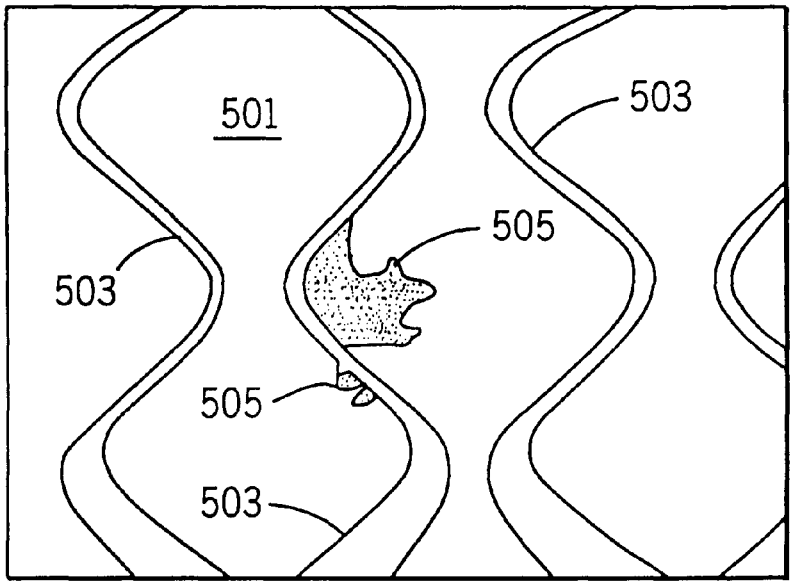
FIG. 27 is a schematic view of the grain structure of a rotogravure cylinder plated according to a conventional method.
Figure 29:
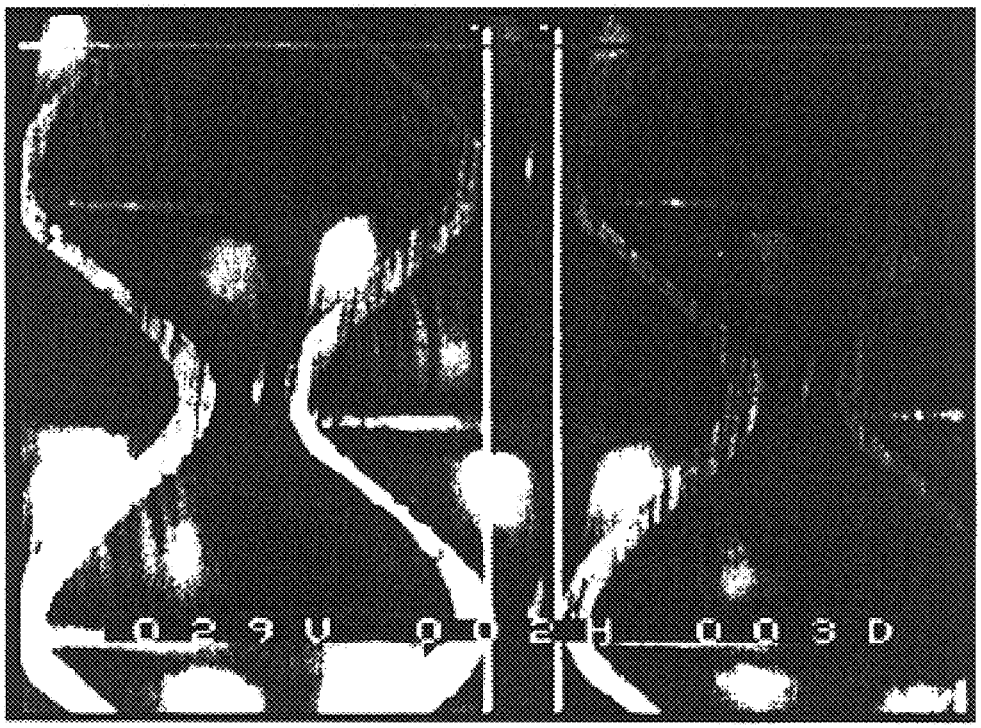
FIG. 29 is a photomicrograph of the surface of a rotogravure cylinder intended to correspond to FIG. 27.

The surface plated according to an embodiment of the present invention will exhibit an engraved cell structure 500 as shown in FIG. 28 (schematic diagram) and FIG. 30 (photomicrograph), with cell walls 502 of a generally consistent width and shape and relatively and substantially free of "burrs" or other undesirable deposits of material following the engraving process. By conventional methods, shown in FIGS. 27 and 29, the structure of cell 501 is somewhat less consistent in form and dimension, as well as having material deposits 505 on or near walls 503 that may cause irregularities or defects during printing, see "The Impact of Electromechanical Engraving Specifications on Streaking and Hazing," *Gravure* (Winter 1994), which is incorporated by reference herein. Cells 500 of a consistent structure, as shown in FIGS. 28 and 30, with less distortion and less damage during engraving, provide a surface on the cylinder which can more efficiently be inked and cleaned and which is therefore more capable of printing a high quality image in the final product. When, as according to the present invention, such uniformity and consistency can be achieved across the length of the cylinder (not just in isolated portions of the surface), the overall printing quality is enhanced.

ADDITIONAL ALTERNATIVE EMBODIMENTS—PART 3

Figure 31:
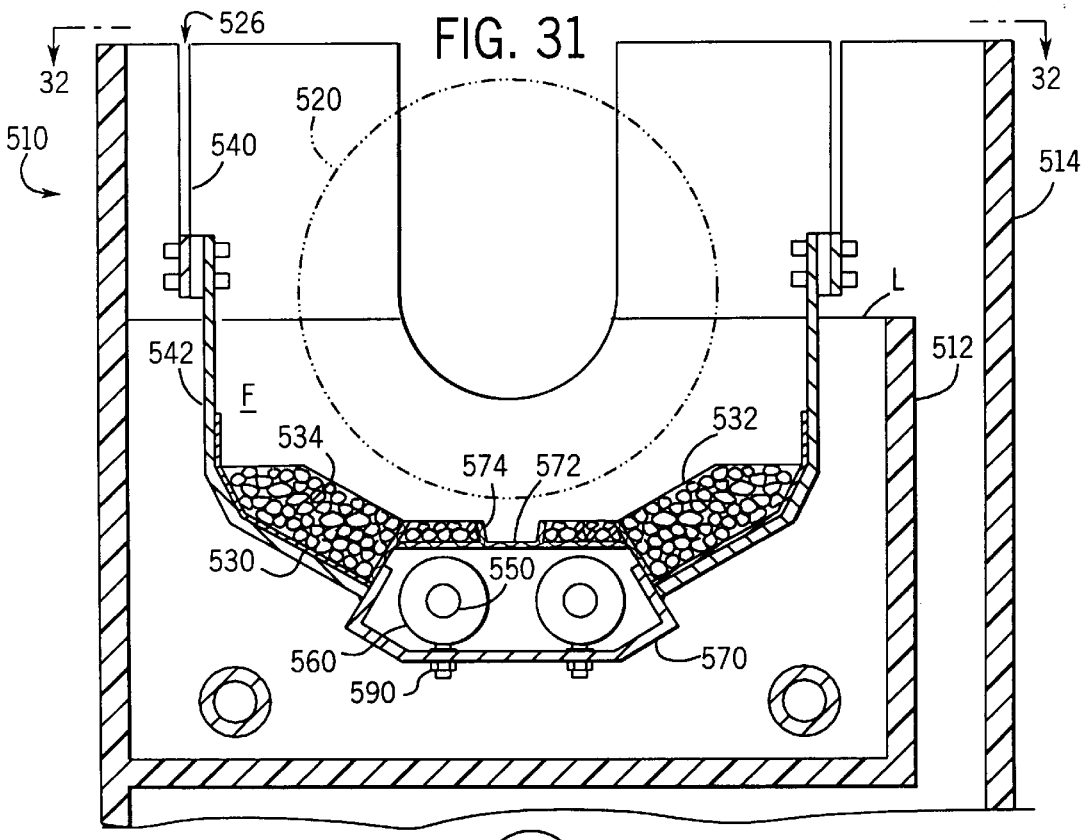
FIG. 31 is a sectional end elevation view of an apparatus for plating a rotogravure cylinder according to an alternative embodiment.
Figure 32:
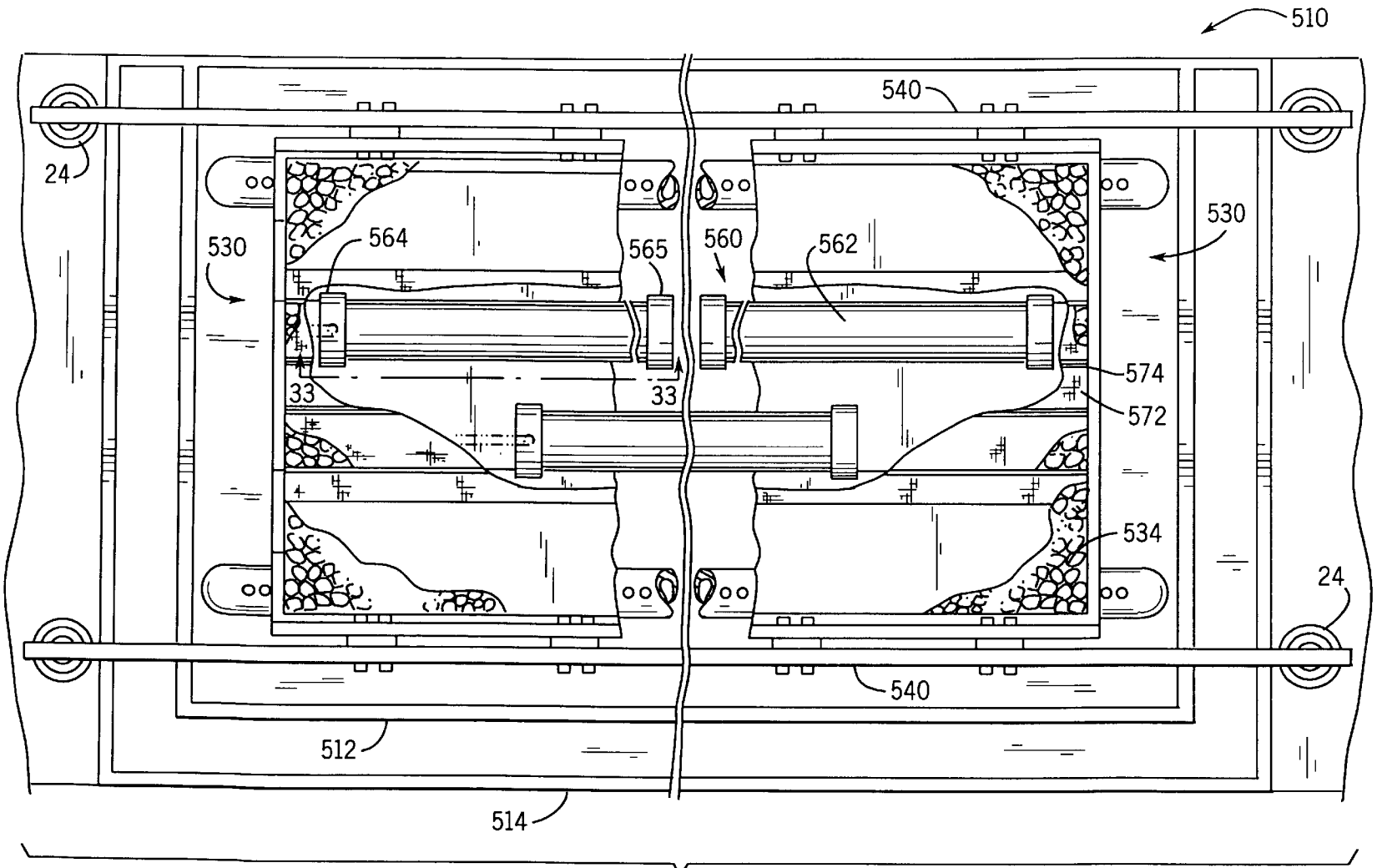
FIG. 32 is a cut-away plan view of an alternative embodiment of the apparatus.
Figure 35:
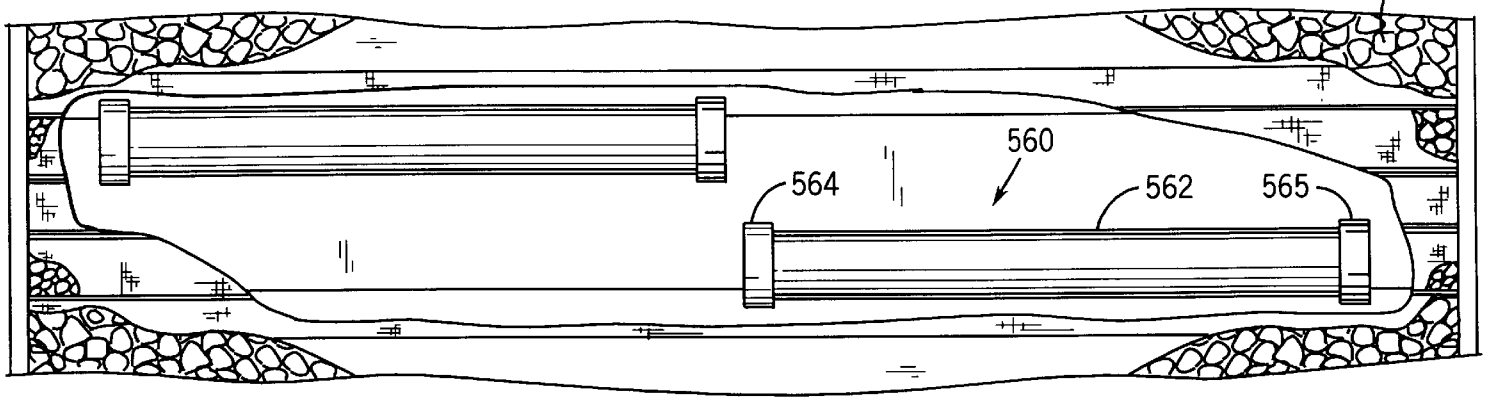
FIG. 35 is a plan view of the transducer assembly.
Figure 36:
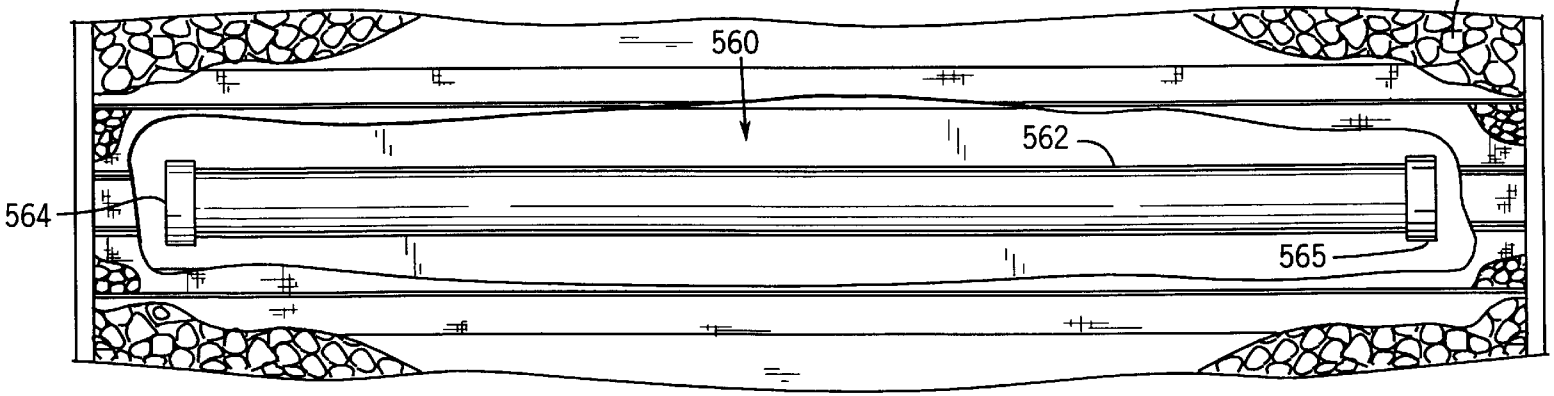
FIG. 36 is a plan view of the transducer assembly according to an exemplary embodiment.
Figure 37:
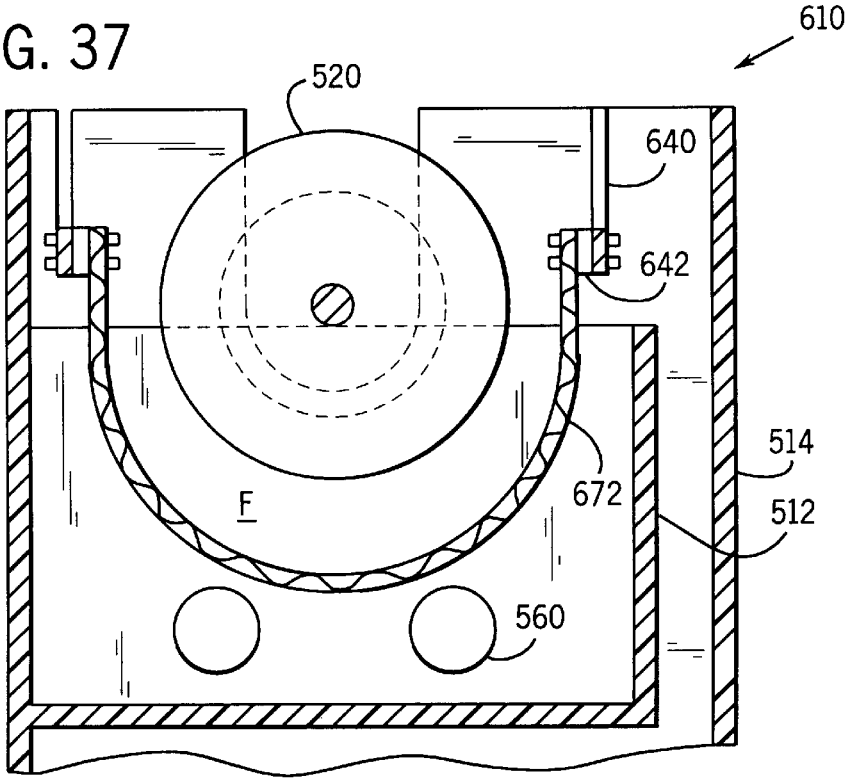
FIG. 37 is a schematic sectional end elevation view of an apparatus for plating a rotogravure cylinder directly out of a plating solution according to an alternative embodiment.
Figure 38:
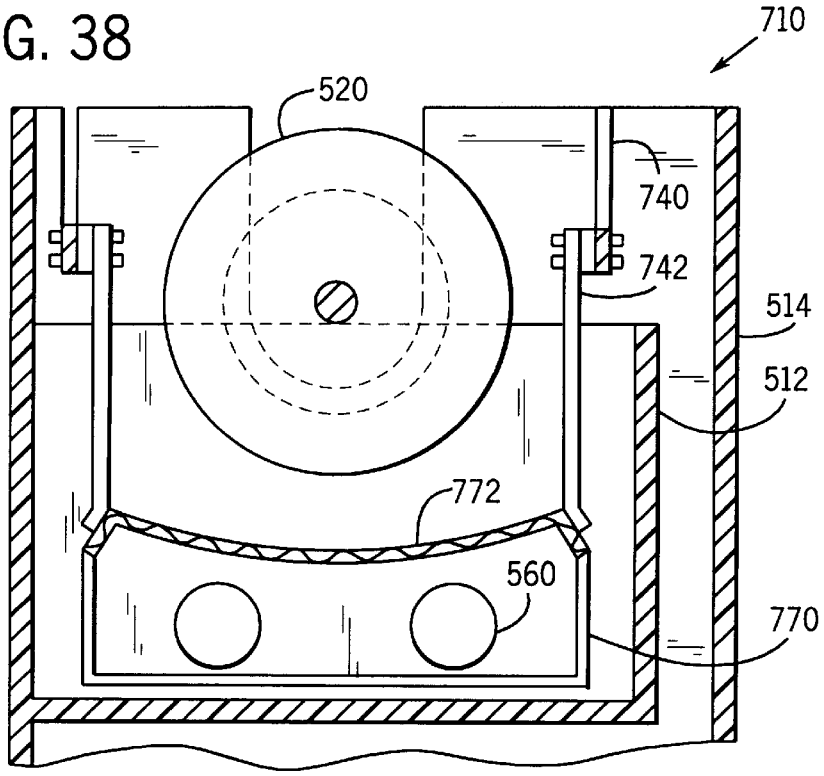
FIG. 38 is a schematic fragmentary end elevation view of an apparatus for plating a rotogravure cylinder directly out of a plating solution according to an alternative embodiment.
Figure 39:
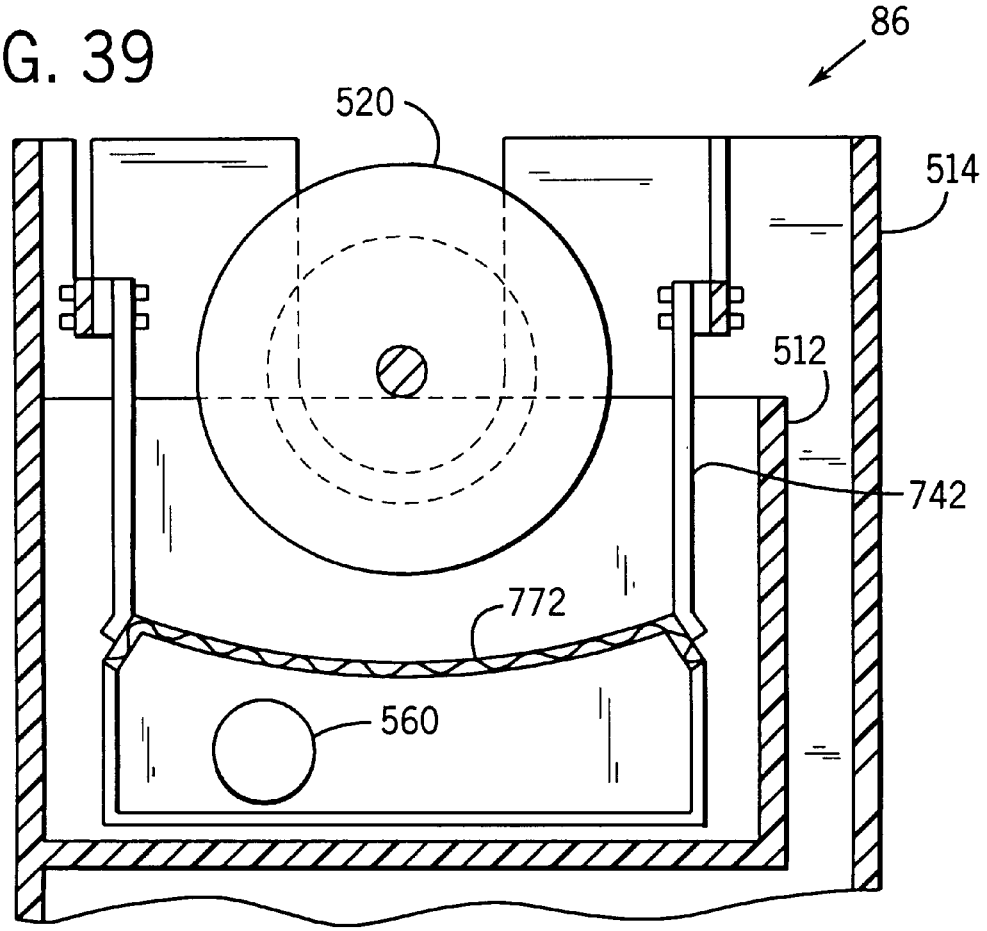
FIG. 39 is a schematic fragmentary end elevation view of an apparatus for plating a rotogravure cylinder directly out of a plating solution according to an alternative embodiment.

According to additional alternative embodiments, an apparatus for electroplating a rotogravure cylinder is shown in FIGS. 31 through 39. Many of the elements of other embodiments described herein are also present in the apparatus, or can be included in the apparatus according to various other alternative embodiments. In FIGS. 31 and 32, an apparatus 510 is shown with basket compartments 532 and associated elements to plate a rotogravure cylinder 520 (not shown in FIG. 32) from copper nuggets 534 in a plating solution indicated by reference letter F. In FIGS. 37 through 39, an apparatus 610 (FIG. 37), an apparatus 710 (FIG. 38), and an apparatus 810 (FIG. 39) are each shown according to an alternative embodiments (without any basket compartments or associated elements) adapted to plate rotogravure cylinder 520 directly out of an electrolytic fluid (a plating solution containing a plating metal or metal alloy indicated by reference letter F).

Referring to FIGS. 31 and 32, apparatus 510 includes a plating tank 512 (of a type shown in FIG. 1) containing plating solution F at a level (indicated by reference letter L). A holding tank (of a type shown in FIG. 1) can be positioned in any suitable location near the plating tank. A rotogravure cylinder 520 to be plated is rotatably supported at its ends (e.g. upon an extending central shaft rotating within bearings), and submerged in plating solution F approximately one-half to one-third of the cylinder diameter. Rotogravure cylinder 520 is rotatably driven by a suitable powering device (not shown). According to any preferred embodiment, the tank system, cylinder mounting, and drive system are of conventional arrangements known to those of skill in the art of rotogravure cylinder plating. (Arrangements that may be adapted to incorporate the various embodiments of the present invention are commercially available, for example, from R. Martin AG of Terwil, Switzerland.) The electrolytic fluid may itself be of a composition known to those of skill in the art of plating of rotogravure cylinders.

Figure 34:
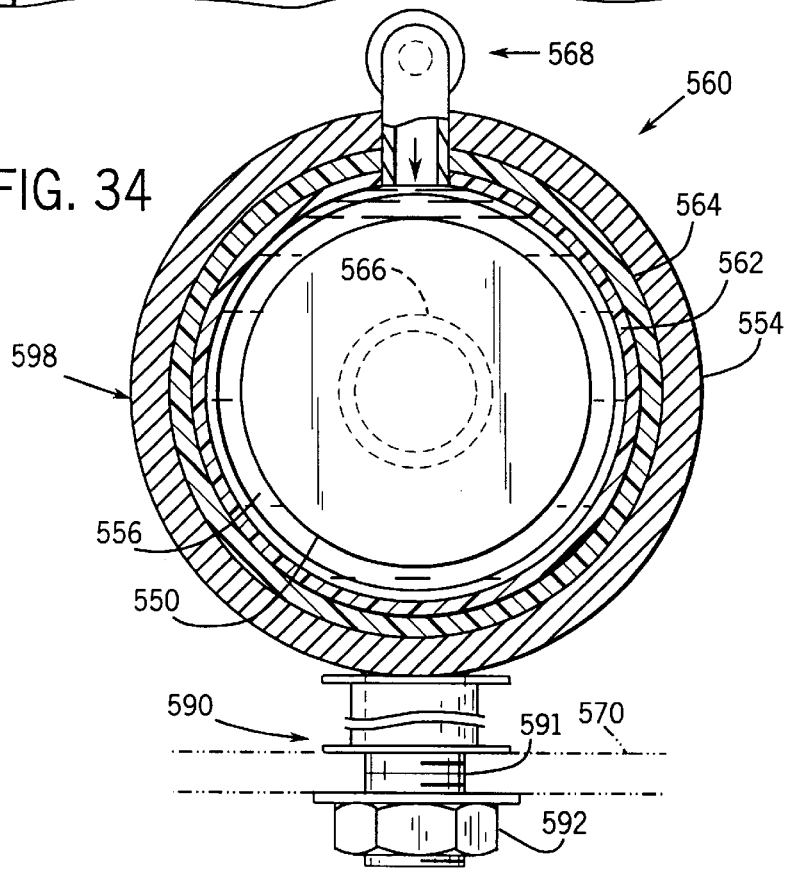
FIG. 34 is an end sectional elevation view of the transducer assembly.
Figure 33:
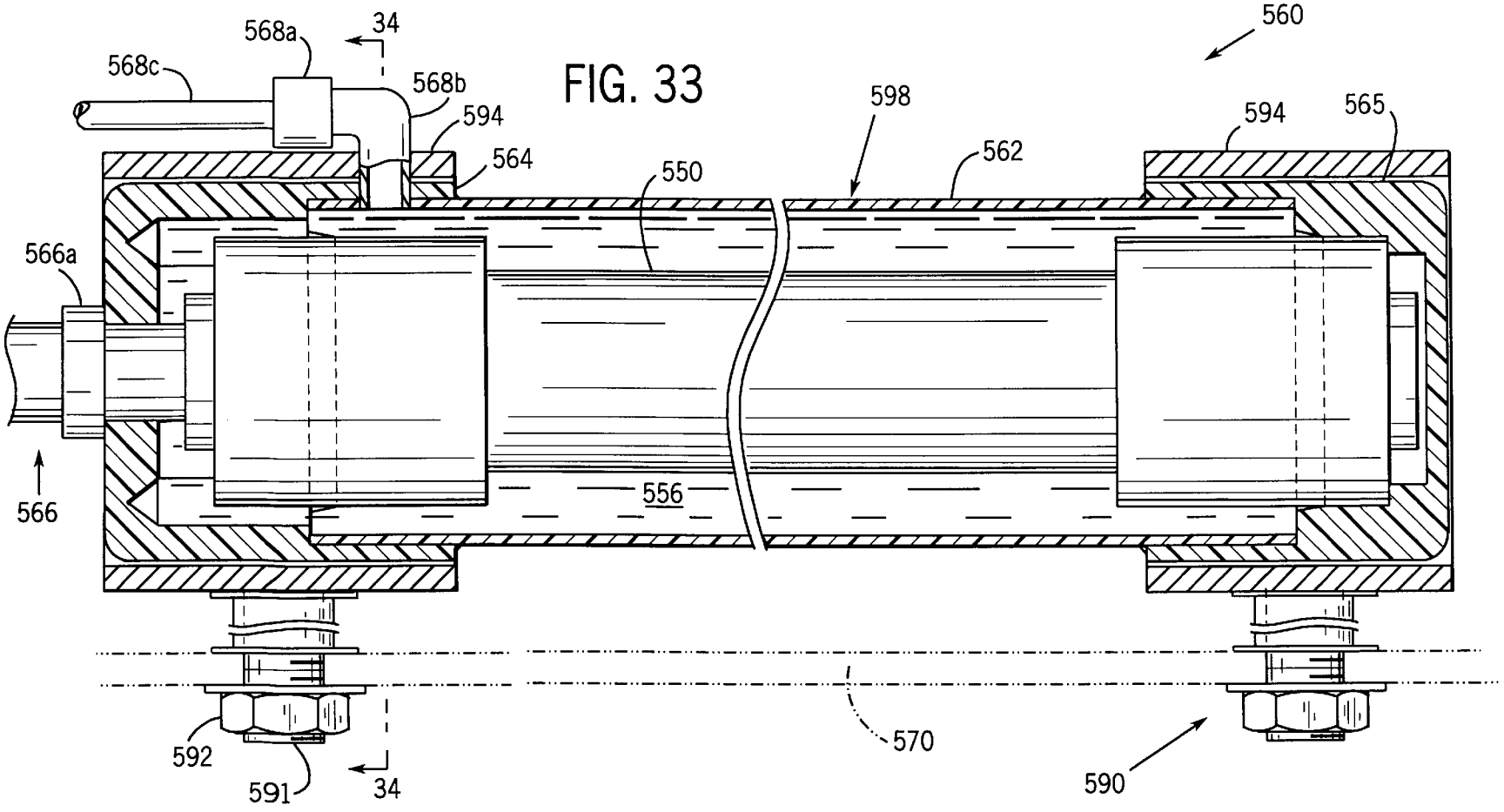
FIG. 33 is a side sectional elevation view of a transducer assembly according to an exemplary embodiment.

According to a particularly preferred embodiment, a transducer assembly is installed within the apparatus. The transducer assembly within which a transducer element is installed is configured to protect the transducer element from the effects of the plating solution (e.g. to protect the transducer element from corrosion or chemical attack by the plating solution) and the plating process (e.g. to prevent a build-up of plating material or waste matter (sludge) on the transducer element and related structures within the plating tank) as well as to provide electrical isolation. As shown for example in FIGS. 33 and 34, a transducer assembly 560 includes a transducer element 550, a protective cover 598, and a transducer mounting structure 590 (e.g. any conventional mounting arrangement). According to any particularly preferred embodiment, other elements of the transducer assembly (e.g. transducer elements and mounting structures) are preferably provided with a resistant coating and/or made from a resistant material and/or covered with protective material of some kind (e.g. a plastic material, electrical tape or heat-shrink tubing or the like). In FIGS. 33 and 34, transducer assembly 560 includes protective cover 598 with an outer sleeve or tube 562 and end caps 564 and 565 surrounding and enclosing transducer element 550. Tube 562 is larger than transducer element 550 and therefore an annular space 556 is created when transducer element 550 is installed within tube 562. A fluid (e.g. deionized water or tap water or a fluid. exhibiting similar properties) is filled into space 556 between transducer element 550 and tube 562. In any preferred embodiment, after transducer element 550 is installed, space 556 (in communication with a fluid supply line assembly 568) between tube 562 and transducer element 550 is filled with fluid so as to substantially entirely displace any air in space 556. The fluid is intended to protect transducer element 550 (e.g. from the effects of the plating solution) without unduly absorbing ultrasonic energy transmitted by transducer element 550 into the plating solution. Water (e.g. deionized and of suitable purity) is particularly preferred as the fluid in space 556 because of its low cost and because any accidental leakage of fluid into plating tank 512 would not be likely to contaminate the plating solution (e.g. typically an aqueous solution). According to alternative embodiments, the fluid may be tap water or other suitable solutions. The fluid is maintained at the proper level under pressure within fluid supply line assembly 568 in order to keep space 556 (shown in approximate scale of an exemplary embodiment) surrounding transducer element 550 in transducer assembly 560 filled with the fluid. The fluid supply line assembly may include a clear supply line (e.g. a hose 568*c*) so that the fluid level can be monitored (and maintained) manually; alternatively an automated system may be used to maintain the fluid level.

According to a preferred embodiment, tube 562 is made of a plastic material. According to a particularly preferred embodiment tube 562 is made of a hard plastic material, such as Kynar™, having a wall thickness of 2 to 3 mm. On either end of tube 562 are end caps 564 and 565, which are preferably made of the same material as tube 562. End caps 564 and 565 can be joined to tube 562 via methods commonly known in the art of plastic tube joining. End caps 564 and 565 preferably are configured (e.g. by molding or machining or the like) to receive and support transducer element 550 so that it remains centered in tube 562 of protective cover 598. According to any preferred embodiment, the protective cover will not only protect the transducer element from the effects of the plating solution but will also not unduly impair the efficiency of transmission of ultrasonic energy into the plating tank.

Protective cover 598 accommodates a conduit assembly 566 (e.g. including a hose or tube 566*b* coupled through an end fitting 566*a*) and a fluid supply line assembly 568 (e.g. including a hose or tube 568*c* coupled through a fitting 568*a* and an elbow 568*b*). End cap 564 or 565 (end cap 564 in FIG. 33) may contain an opening 564*a* for receiving fitting 566*a* of conduit assembly 566 (e.g. for power cables contained in tube 566*b* to transducer element 550) and an opening 564*b* for receiving elbow 568*b* of fluid supply line assembly 568 (e.g. a supply line for replenishing or recirculating and/or refilling fluid into space 556). Each opening (and its fitting) is preferably securely sealed to prevent leakage of the plating solution into the transducer assembly (or the plating solution into space 556). Preferably, end caps 564 and 565, tube 562, conduit assembly 566, and fluid supply line assembly 568 are also securely sealed (e.g. liquid tight) during assembly and installation and regularly inspected in use. (Fluid supply line assembly 568 and the conduit assembly 566 can be connected to the same or different end cap.) As shown, the conduit assembly and fluid supply line assembly can be made of components commonly known in the art, such as flexible tubing, tube fittings, heat shrink tubing, straight fittings, etc. (preferably resistant to the effects of the plating solution), and each is fit tightly within transducer holder 554 (e.g. to prevent leakage and/or exposure of the transducer element and other contents of the transducer assembly to the plating solution). According to an alternative embodiment (not shown), the conduit assembly and the fluid supply line assembly can be combined into a single conduit assembly that carries both the electrical cable to the transducer element and the fluid into the space surrounding the transducer element.

As shown in an exemplary embodiment in FIG. 34, the mounting arrangement for transducer assembly 560 includes supports 590 (one at each end). Each support 590 may include an at least partially threaded rod 591, held at its base by two nuts 592 (with washers, such as shown) to a mounting structure (which may be, for example, a transducer tray 570 or an anode strip 542 or other member). A set of transducer holders 554 (shown as collars) are securely attached to rod 591 of support 590 (e.g. by a fastener arrangement or other suitable method of attachment known to those in the art). According to a particularly preferred embodiment, the mounting arrangement will allow the position of the transducer assembly relative to the rotogravure cylinder to be adjusted, for example, according to the size of the rotogravure cylinder to be plated (i.e. if the rotogravure cylinder has a small diameter, transducer elements typically should be adjusted closer to the cylinder in an attempt to optimize the effect of the ultrasonic energy).

According to any preferred embodiment, the transducer element is provided with some type of protective outer cover, preferably electrically isolated and resistant to the chemical and other effects of the plating solution. For example, the transducer element may have a multi-layer protective cover with an outer layer such as tube 562 and an inner covering sleeve (or like material) that forms a tight fit to the transducer element, made of "heat shrink" tubing, of a material (such as plastic or a like "inert" material) that is resistant to the effects of the plating solution (see e.g. protective cover 498 in FIG. 26). According to other alternative embodiments, the protective cover may include a layer of protective coating material (e.g. a coating) that can be applied directly to the transducer element by spraying, brushing, dipping, etc. (in place of or along with other "layers" or elements of protective cover). According to any alternative embodiment, the protective cover for the transducer element may be provided in a wide variety of forms and can include one or more layers of material or one or more elements (e.g. coating, wrap, sleeve, tube, fluid filled tube, etc.) that provides the protective function.

Referring again to FIG. 31, apparatus 510 includes a mounting structure shown as transducer tray 570. At least one transducer assembly 560 (two are shown) can be attached to transducer tray 570 via supports 590. Tray 570 is supported by rails 540 and anodes 542 (in a particularly preferred embodiment, each anode is made of titanium). Nuggets 534 are contained in baskets 532, outside and above the walls of transducer tray 570, a set of partitions 574, and anodes 542 (which are in contact with nuggets 534). As shown in FIG. 31, transducer tray 570 includes partitions 574 and power anode 572, which form a space between nugget trays 530 (transducer tray 570 is at least partially covered by power anode 572). The power anode (preferably made of titanium) increases the total anode surface (or cathode surface for deplating), which provides for greater efficiency (and consistency) in the electroplating process. Power anode 572 is configured to incorporate partitions 574 thereby creating a space in the middle of the anode where no nuggets are placed. Accordingly, ultrasonic energy has a substantially less obstructed path from transducer element 550 to rotogravure cylinder 520 (e.g. as shown in FIG. 31 the spacing between two nugget trays 530 provided by partitions 574 provides an at least partially unobstructed flow path for the ultrasonic energy discharged from the transducer element 550). Power anode 572 and partitions 574 are preferably made of an electrically conductive mesh or expanded metal (e.g. having apertures). According to any particularly preferred embodiment, the apertures within the mesh (or expanded metal) not only create flow paths for circulation of the plating solution and transmission of ultrasonic energy, but also increase surface area for electrical contact (e.g. with the nuggets and/or plating solution).

As shown in FIG. 32, basket system 530, plating tank 512, holding tank 514, rails 540, and transducer assemblies 560 are disposed upon a set of lifters 24 (e.g. hydraulic cylinders), which allow the vertical position of the rotogravure cylinder (not shown) to be adjusted within plating tank 512 (in a set of slots 526 in the end walls of plating tank 512 that are adapted to form a leak-proof seal with rail 540). The distance from the surface of the rotogravure cylinder to basket system 530, which is beneath the rotogravure cylinder, may be adjusted, for example, according to the diameter of the rotogravure cylinder.

FIGS. 32, 35, and 36 show according to alternative embodiments, the apparatus using arrangements of three, two or one transducer assemblies (each with a transducer element), respectively. (The number of transducer elements installed in the apparatus may depend on such factors as the length of the rotogravure cylinder and the length of transducer element (or elements).) In any preferred embodiment, the transducer element (or elements) should be arranged to provide for a uniform ultrasonic energy distribution as to promote uniformity of plating along (and of) the rotogravure cylinder. (Thus, any preferred embodiment will have at least one transducer element extending along substantially the entire length of the rotogravure cylinder, alternative embodiments may have the transducer elements installed in other arrangements or geometries, possibly crosswise or skewed.) Generally, the apparatus will contain between one and three transducer elements. (Use of four or more transducer elements is possible, but typical rotogravure cylinders are generally not of a length which would require more than three elements to obtain suitable ultrasonic energy coverage.) As shown in FIGS. 32 and 35, transducer assemblies 560 can be arranged (e.g. "staggered") at opposite sides of rotogravure cylinder 520; some "overlap" of transducer assemblies 560 ensures or promotes a complete or suitable coverage of the ultrasonic energy along the surface of the cylinder. FIGS. 36 and 39 show an apparatus having only one transducer element assembly 560. The location of the single transducer assembly (or of any one in a group) can be centered upon (as in FIG. 36) or offset from (as in FIG. 39) the longitudinal centerline of the rotogravure cylinder.

FIGS. 37 through 39 show additional alternative embodiments of the apparatus modified for plating or deplating rotogravure cylinder 520 with various metallic alloys or metals directly out of solution (i.e. without using metallic nuggets), for chromium, zinc, nickel, or other plating metal or alloy, according to various processes known in the art. Referring to FIG. 37, apparatus 610 includes a pair of transducer assemblies 560 configured to be mounted (below rotogravure cylinder 520) to the structure of plating tank 512 through a power anode 672 suspended from rails 640 and anodes 642. Similarly, in FIG. 38, apparatus 710 includes a transducer tray 770 configured to support a pair of transducer assemblies 560; apparatus 710 includes rails 740, and anodes 742, with a power anode 772 (to which transducer tray 770 can be mounted). FIG. 39 shows an apparatus 810 similar to that of FIG. 38, except that a single transducer assembly 560 is provided within transducer tray 770, and is shown offset from a vertical centerline of rotogravure cylinder 520. (The single transducer assembly 560 can alternatively be located on the center line, as is shown in FIG. 36.) As shown in the exemplary embodiments, transducer tray 770 is suspended from anodes 742 through power anode 772, with power anode 772 in electrical communication with anodes 742.

ADDITIONAL ALTERNATIVE EMBODIMENTS—PART 4

According to additional alternative embodiments, an apparatus incorporating a non-dissolvable anode (i.e. an anode (or cathode for deplating) made from a conductive material substantially resilient to the plating solution, or a conductive material including, at least partially, a surface material that is substantially resilient to the plating solution) for plating or deplating a rotogravure cylinder with various metallic alloys or metals directly out of solution (i.e. without using metallic nuggets) to produce a uniform and consistent grain structure on the surface of the plated cylinder is shown in FIGS. 40 through 49.

Figure 40:
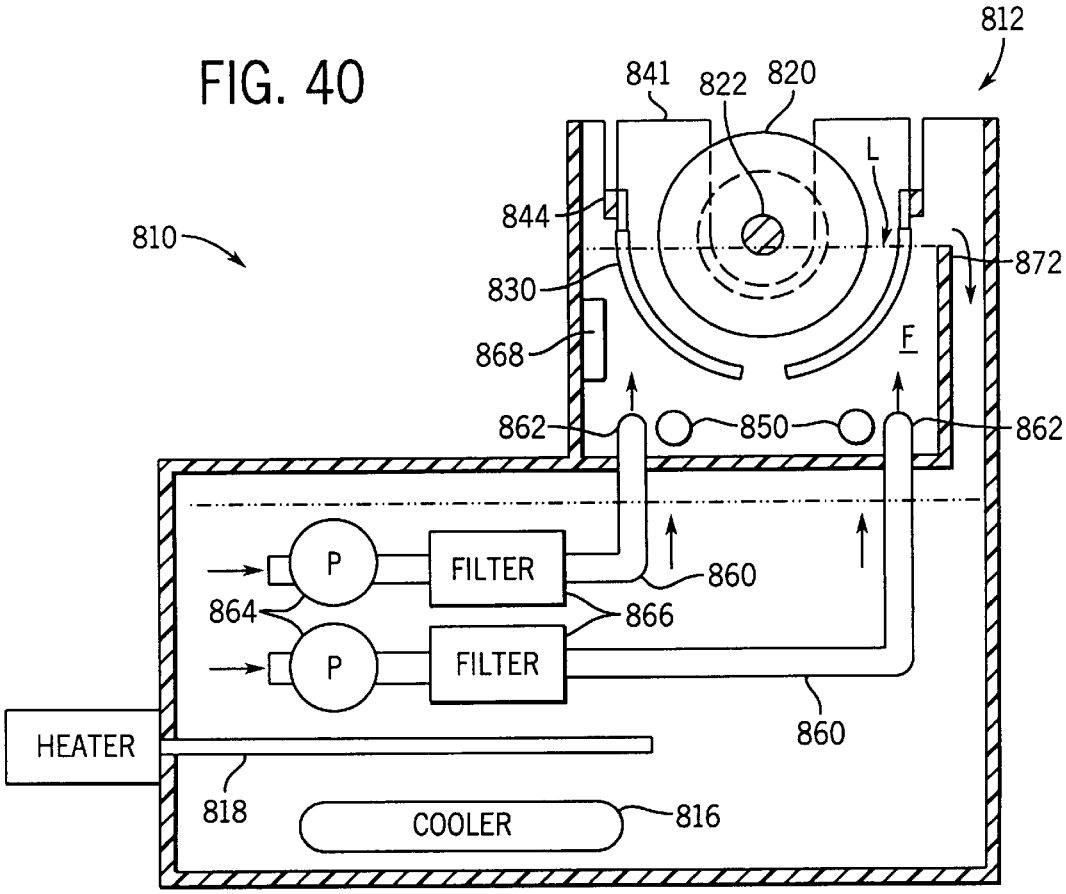
FIG. 40 is a schematic sectional elevation view of an electroplating apparatus for rotogravure cylinder according to an embodiment utilizing a non-dissolvable anode.
Figure 41:
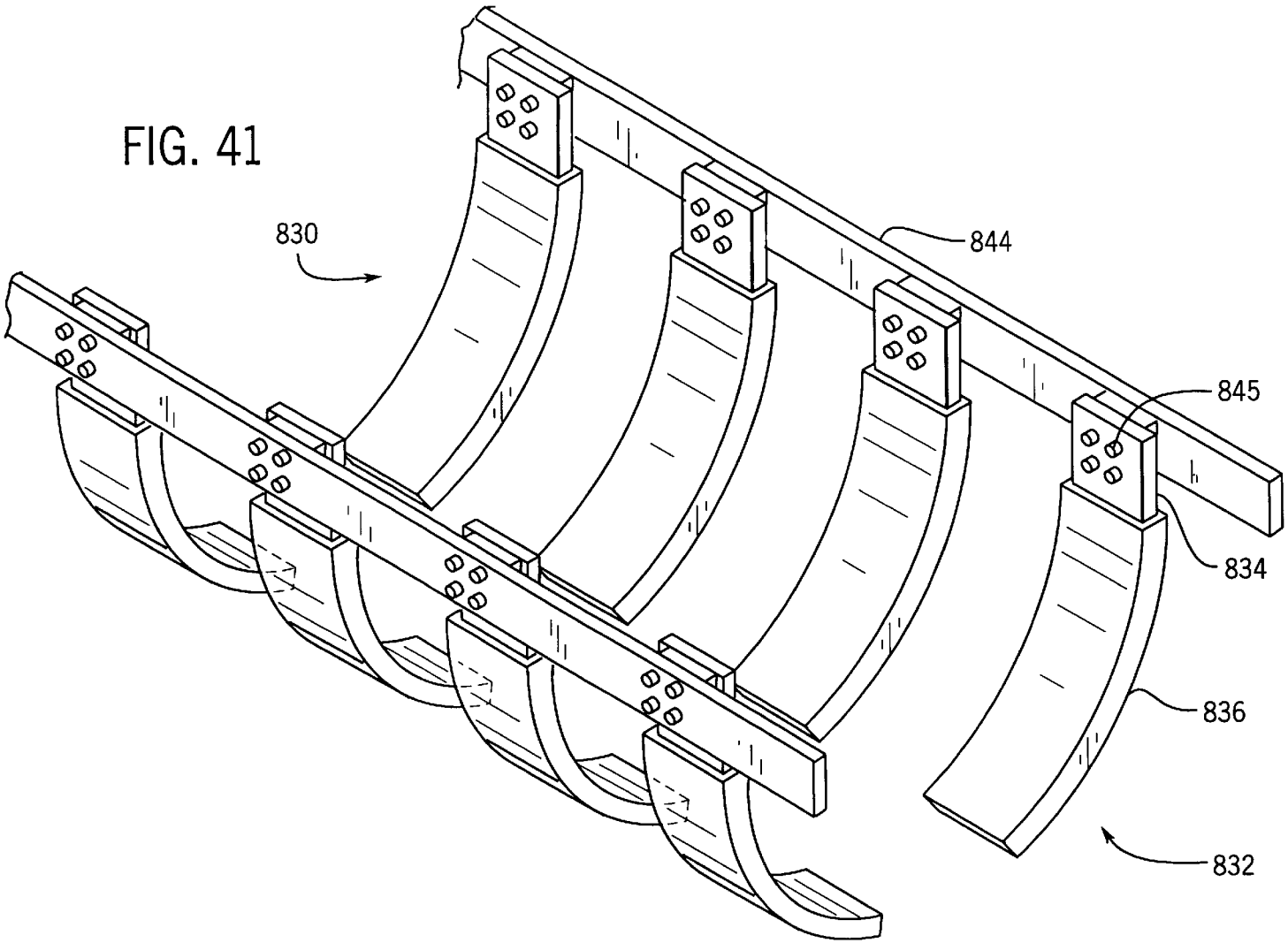
FIG. 41 is a fragmentary perspective view of the non-dissolvable anode of FIG. 1.

Many of the elements of other embodiments described herein are present in apparatus 810, shown schematically in FIG. 40, or can be included in apparatus 810 according to various other embodiments. However, apparatus 810 is adapted to plate an object, shown as cylinder 820, directly out of an electrolytic fluid, a plating solution containing a plating metal or metal alloy in solution indicated by reference letter F. According to this embodiment, cylinder 820 can be plated with any plating metal or metallic alloy. For example, cylinder 820 can be plated with chrome, zinc, nickel, copper or other plating metal (including various alloys thereof according to various processes known in the art.

According to any preferred embodiment, apparatus 810 includes a plating tank 812 and a non-dissolving anode 830, and may include at least one transducer element 850 and a holding tank 814 as shown schematically in FIG. 40.

Figure 42:
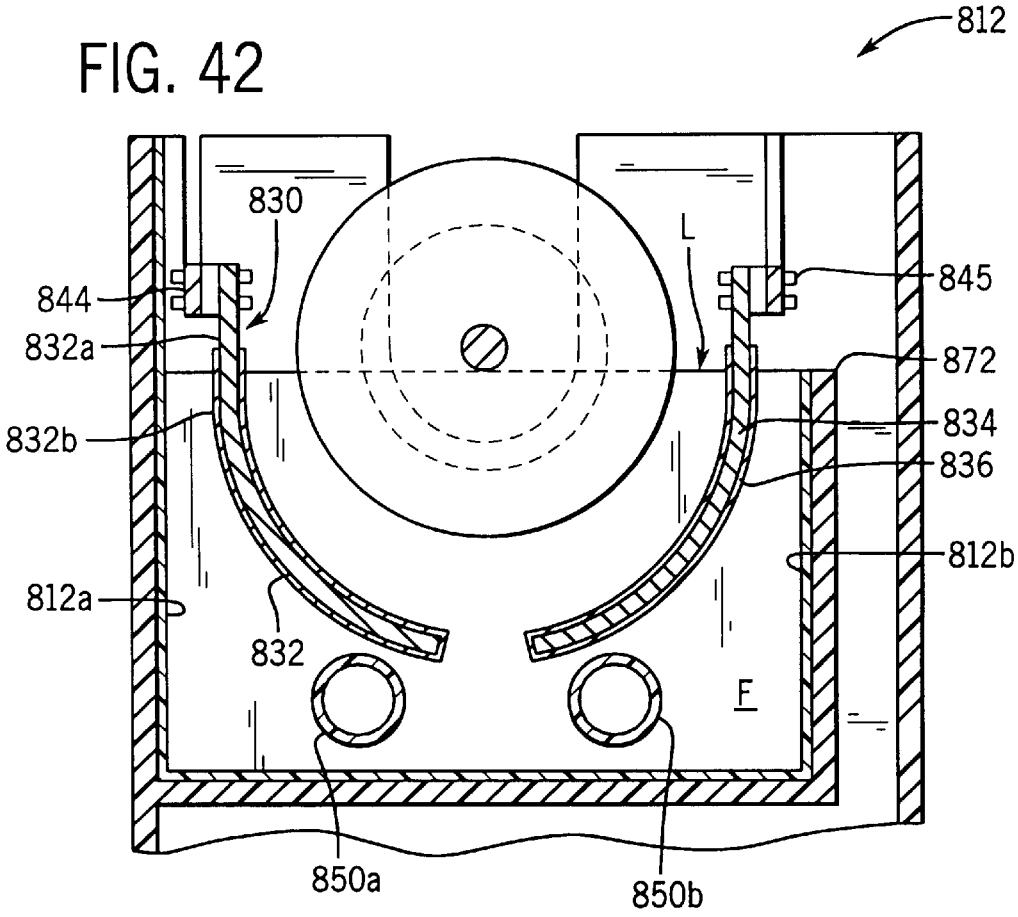
FIG. 42 is a schematic sectional end elevation view of an apparatus for plating a rotogravure cylinder directly out of a plating solution according to an embodiment employing a non-dissolvable anode.
Figure 43:
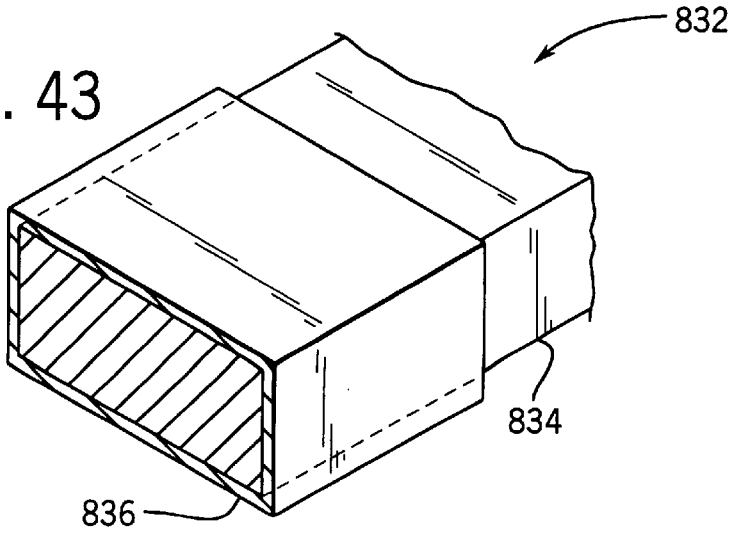
FIG. 43 is a fragmentary perspective view of a conductor having a generally rectangular cross-section.

According to a preferred embodiment of a type shown schematically in FIGS. 40 and 42, apparatus 810 includes a plating tank 812 containing the plating solution (electrolytic fluid F) at a level indicated by reference letter L and preferably regulated by the height of a weir 872, although a variety of methods for controlling the fluid level may be used (i.e. a pump, drain, sensor etc.). Plating tank 812 can take a variety of different shapes and sizes and may be manufactured from any one or a combination of suitable materials. In an exemplary embodiment, plating tank 812 is formed of a material that is substantially resilient to the plating solution (e.g. titanium, plastic, rubber, graphite, glass, etc.), or includes a protective surface material 824 (e.g. lining, coating, covering, surface treatment, etc.) that is substantially resilient to the plating solution.

A rotogravure cylinder 820 to be plated (or deplated) is rotatably supported at its ends (e.g. upon an extending central shaft) and fully or partially submerged into the electrolytic fluid, preferably approximately one-half to one-third of the cylinder diameter. As shown in FIG. 40, cylinder 820 is rotatably supported at its ends by bearings within a journal 822, in which it is rotatably driven by a suitable powering device (not shown). Cylinder 820, shown in FIGS. 42 and 45, may be one of a standard size (e.g. having a diameter of approximately 800 to 1500 mm), or, according to alternative embodiments, cylinders of other diameters may be accommodated. Cylinder 820 may be one of a common or standard length for a particular application (e.g. having a length of approximately 40 cm to 4 m), or, according to alternative embodiments, cylinders of other lengths may be accommodated. According to any exemplary embodiment, the cylinder mounting and drive system is of a conventional arrangement known to those of ordinary skill in the art of rotogravure cylinder plating.

Referring to FIG. 42, apparatus 810 includes a non-dissolvable anode 830 in electrical contact with the plating solution (electrolytic fluid F). For plating cylinder 820, the non-dissolvable anode is connected to an anode side of a plating power supply (e.g. a current source of known design) and the cylinder is connected to a cathode side of the power supply. For deplating, the anode-cathode connections are reversed. When the cylinder is printed out (i.e. after having been plated and etched), it is returned to the plating apparatus and deplated so as to return the plating metal to the solution. According to alternative embodiments, other conventional arrangements for effecting the electrical connections to the plating solution (electrolytic fluid F) and the cylinder may be employed.

As shown in FIG. 42, preferably the non-dissolvable anode 830 is suspended from a pair of rails 844 generally extending along walls 812*a* and 812*b* of the plating tank. (In FIG. 40, rails 844 are shown mounted from a reinforcing structure 841, according to an alternate embodiment, the ends of the rails may be supported by the tank ends or side walls.)

Non-dissolvable anode 830 includes at least one conductor 832 made from a conductive material substantially resilient to the plating solution, or, preferably, a conductive material including, at least partially, a conductive protective surface material 836 substantially resilient to the plating solution. Non-dissolvable anode 830 may include a protective surface material (e.g. a sleeve, coating, surface treatment, powder coating, or other covering) along its entire surface area, along a substantial portion of its surface area, or along only part of its surface area. Preferably, at least those portions of non-dissolvable anode 830 that may be exposed to corrosion or chemical attack by the plating solution (electrolytic fluid F) will include protective surface material 836. Non-dissolvable anode 830 may include a continuous conductor (i.e. a conductive plate disposed near cylinder 820), a plurality of conductors coupled to or contacting one another, or a plurality of independent conductors 832 separately coupled to a power supply. According to an exemplary embodiment, shown schematically in FIG. 42, conductors 832 are disposed around each side of cylinder 820 and follow the general shape or curve of cylinder 820. Preferably, conductors 832 are mechanically fastened and electrically coupled to current carrying rails 840 at junctions employing fasteners, shown as bolts 845. According to a particular preferred embodiment, a heavier weight conductor, or increased number of conductors, are employed to increase the total anode weight or surface area (or cathode weight or surface area for deplating), which provides for greater efficiency (and consistency) in the electroplating process by allowing usage of an increased current density (i.e. higher amperage and lower voltage). Typically, an increased current density reduces the plating time but increases the number or duration of additional polishing steps. However, utilizing a non-dissolving anode with an increased current density not only reduces the plating time, but also minimizes the number or duration of additional polishing steps by the reducing the amount of copper (or other) sludge in the plating tank that may adhere to the cylinder causing uneven or undesirable deposits.

According to a preferred embodiment, conductor 832 includes a conductive core 834 covered by a conductive surface material 836 substantially resilient to the plating solution (e.g. graphite). According to alternative embodiments, protective surface material 836 may include a layer of protective material (e.g. a coating) that can be applied directly to the core by spraying, brushing, dipping, powder coating, washing etc. (in place of or along with other "layers" or elements of protective cover). According to any alternative embodiment, the protective surface material for core 834 may be provided in a wide variety of forms and can include one or more layers of material or one or more elements (e.g. coating, layer, treatment, wrap, sleeve, tube, fluid filled tube, etc.) that provides the protective function. In an exemplary embodiment, core 834 is protected by a protective surface material 836 including or formed from (at least partially) a material such as graphite. According to an exemplary embodiment graphite is applied to protect core 834 using a spray or powder coating. According to a particularly preferred embodiment, protective surface material 836 includes coating or wash having a graphite content of more than 10 percent, and preferably a graphite content of more than 20 percent such as GRAPHOKOTE NO. 4 LADLE COATING (trade name with product data sheet Pds-G332 incorporated by reference herein), commercially available from Dixon Ticonderoga Company of Lakehurst, N.J., U.S.A. According to any preferred embodiment, the protective surface material (e.g. graphite) is securely applied to core 834.

According to a particular preferred embodiment, protective surface material 836 is confined to lower portions 832*b* of conductors 832 that contact the plating solution (electrolytic fluid F). Upper portions 832*a* of conductors 832 may include a protective surface material, or, as shown in FIG. 42, remain without a protective surface material.

According to an alternative embodiment, upper portions 832*a* of conductors 832 include a surface material or additional surface material (conductive or nonconductive) to protect, or further protect the upper portions 842*a* from possible exposure to the plating solution. According to any preferred embodiment, the contact surfaces between non-dissolvable anode 830 and current carrying rails 844 are maintained free of any surface material that may materially diminish the electrical current flowing between non-dissolvable anode 830 and current carrying rails 844.

According to an exemplary embodiment, apparatus 810 includes a non-dissolvable anode 830 that adjusts to accommodate cylinders having different diameters. In one such embodiment, shown in FIG. 45, conductor 832 is coupled to an adjustable rail 844 that is raised or lowered depending on the size of cylinder 820 to be plated or deplated. When a cylinder of a lesser diameter is plated (or deplated), conductor 832 is raised so that conductor 832 is brought to an optimal distance (i.e. 5 mm to 80 mm, preferably 10 mm to 60 mm, or, according to an exemplary embodiment, 10 mm to 30 mm) from cylinder 820 as may be determined for a particular application.

Figure 44:
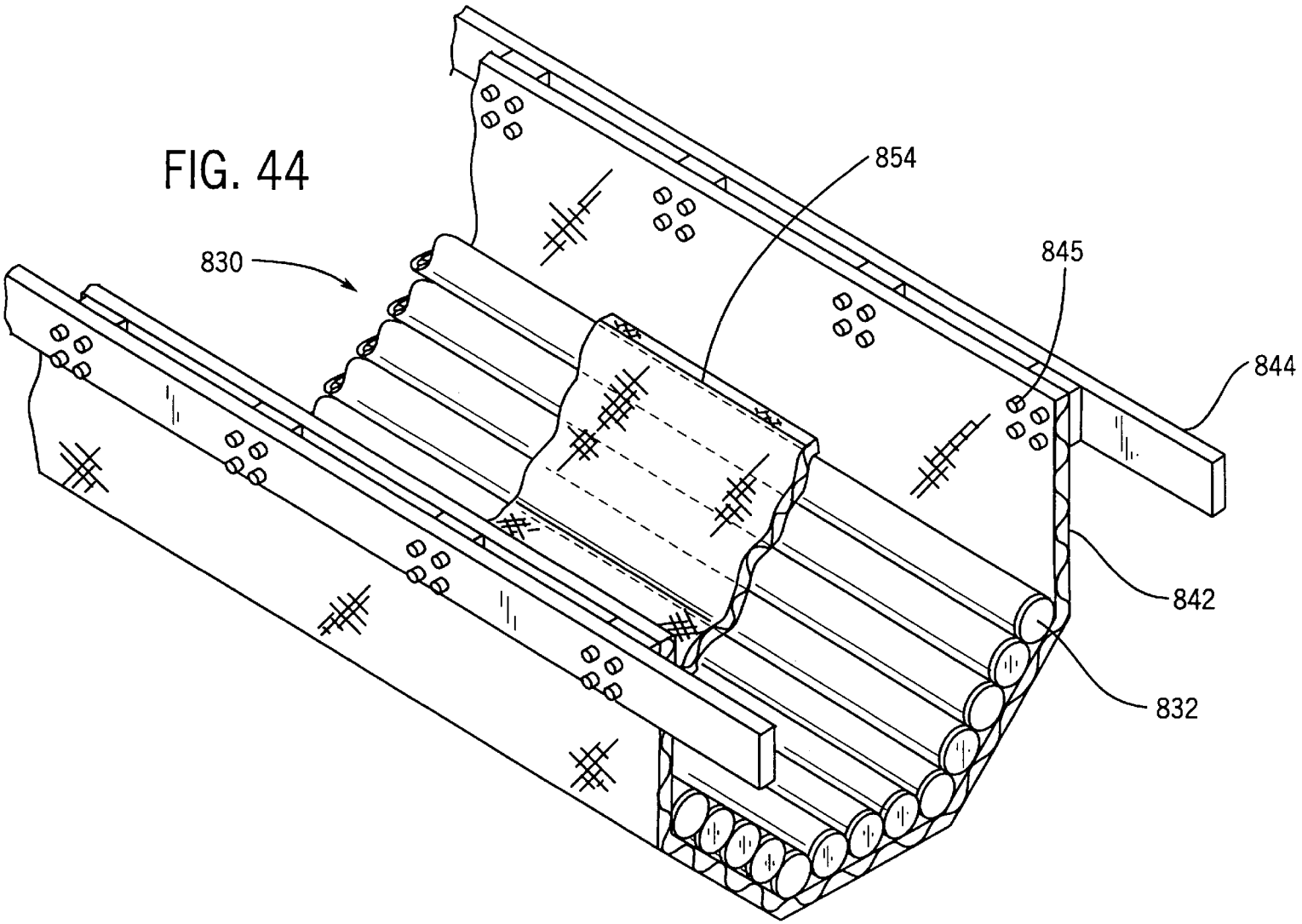
FIG. 44 is a schematic sectional end elevation view of an apparatus for plating a rotogravure cylinder directly out of a plating solution according to an embodiment employing an alternate embodiment of a non-dissolvable anode.
Figure 45:
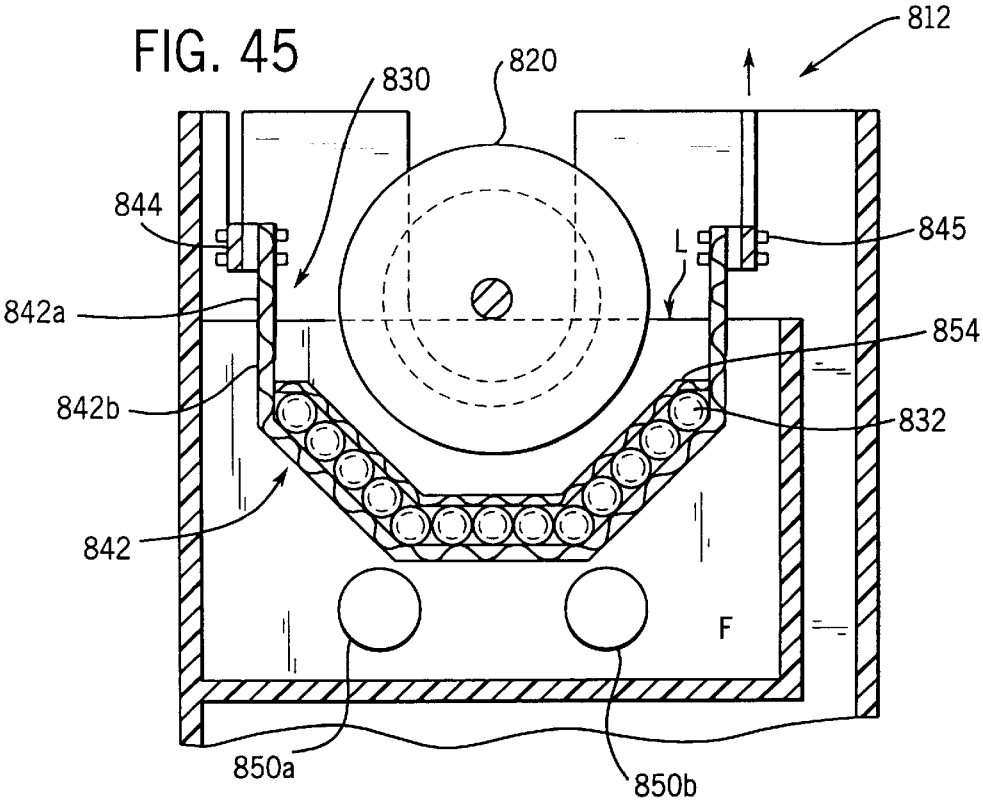
FIGS. 45 and 46 are schematic sectional and elevational views of an apparatus for plating a rotogravure cylinder directly out of a plating solution according to an embodiment employing an additional alternate embodiment of a non-dissolvable anode.

An alternate embodiment of the non-dissolvable anode is shown in FIGS. 44 and 45, in which a non-dissolvable anode 830 includes at least one conductor 832 and at least one support structure 842 (e.g. a curved or angled supporting plate or at least one curved or angled flat supporting strip) that serves as the structural support (i.e. a hanger) for conductor 832. According to a preferred embodiment, support structure 842 acts as conductor 832. According to an exemplary embodiment, a plurality of conductors 832, which may be placed in a variety of configurations, are used. Support structure 842 is mechanically fastened and electrically coupled to current carrying rails 844 at junctions employing fasteners, shown as bolts 845. Upper portions 842*a* of the support structure 842 may include a surface material (conductive or nonconductive) to protect, or further protect the upper portions 842*a* from the plating solution, and lower portions 842*b* of the support structure 842 are positioned to maintain electrical contact with conductor 832. Conductor 832 increases the total anode surface area (or cathode surface area for deplating), which provides for greater efficiency (and consistency) in the electroplating process by allowing usage of an increased current density (i.e. higher amps and lower voltage).

Conductor 832 includes a conductive core 834 made of a material that is substantially resilient to the plating solution, or, including (at least partially) a conductive protective surface material 836 that is substantially resilient to the plating solution. For added protection, a conductor or conductive core made from a material that is substantially resilient to the plating solution may include (at least partially) a conductive protective surface material 836 that is substantially resilient to the plating solution. According to an exemplary embodiment, titanium tubes, which preferably include a protective surface material, are shrunk onto a lead or copper core material. According to an alternate embodiment, support structure 842 includes (at least partially) a protective surface material substantially resilient to the plating solution (i.e. graphite, etc.).

As shown in FIGS. 44*a–c*, conductor 832 may take numerous forms, shapes, or proportions, including having a generally round cross-section (depicted in FIG. 47*a*), a square cross-section (depicted in FIG. 47*b*), a generally rectangular cross-section (depicted in FIG. 47*c*), or of a wide variety of shapes, sizes, proportions, or combinations thereof. According to a preferred embodiment, the ends 835 of core 834 are also protected by a protective surface material 836. According to one embodiment, shown in FIGS. 47*a–c*, surface material 836 includes caps 840 attached to side portions 839 of protective surface material 836. Depending on the type or nature of the protective surface material used, other methods of protecting the ends 835 of core 834 may be implemented.

According to an alternate embodiment, shown in FIGS. 48*a–b*, a hollow tube 846 manufactured from a conductive material that is resilient to the corrosive effects of the plating solution (e.g. graphite, titanium, etc.), or including a conductive protective surface material substantially resilient to the effects of the plating solution, is filled with a plurality of conductive elements or pieces 848. An exemplary embodiment utilizes metallic elements (e.g. lead or copper alloy balls or nuggets) to fill tube 846. Caps 840, attached to tube 846, seal the ends 847 of the tube and contain and protect the conductive elements 848. Depending on the material used to manufacture tubes 846, other methods of sealing the ends of tubes 846 may be implemented. Tubes 846 may take numerous forms or proportions, including a generally round cross-section as depicted in FIG. 48*a*, a generally rectangular cross-section as seen in FIG. 48*b*, or of a wide variety of shapes, proportions, or combinations thereof.

Figure 46:
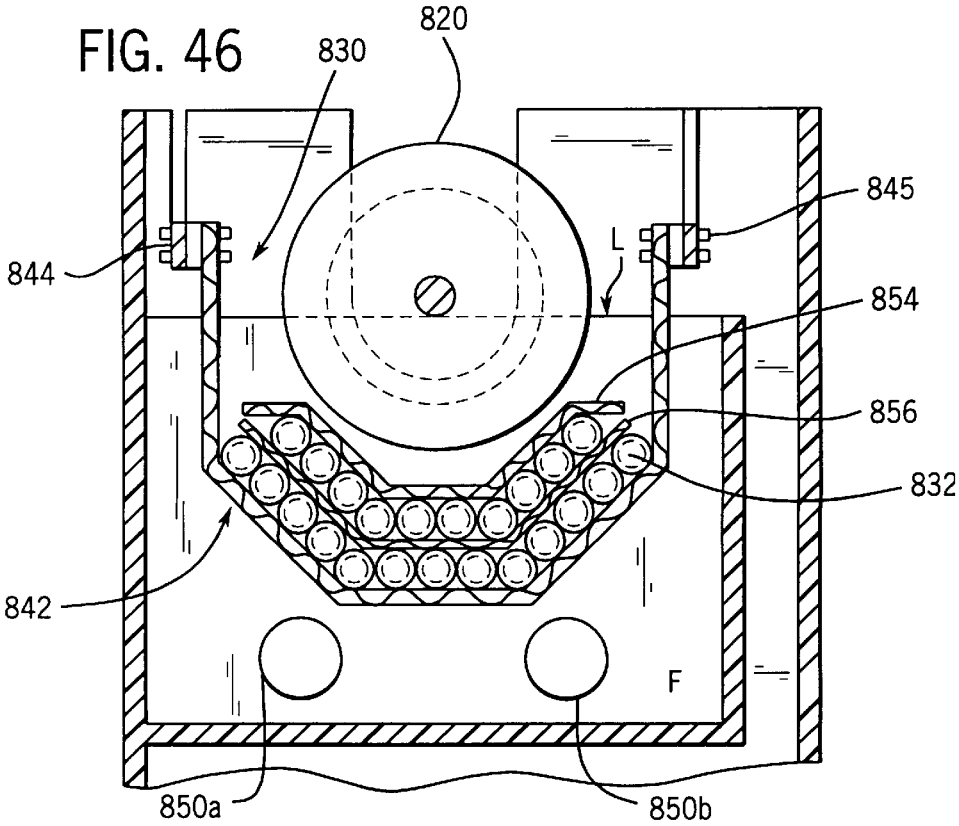

As shown in FIG. 46, apparatus 810 may employ multiple layers of conductors 832, which may be placed in a variety of configurations, thereby further increasing the size (or surface area) of the anode. One row of conductors 832 may be directly "stacked" on another, or, as shown in FIG. 46, be separated by partition 856. Preferably, partition 856 is made of electrically conductive mesh or expanded metal material (e.g. having apertures). Partition 856 is preferably attached to conductors 832 or support structure 844 by welding or other comparable method or fixture. As depicted in FIG. 44, according to a preferred embodiment, non-dissolvable anode 830 includes a covering 854 over conductors 832. Preferably, covering 854 is made of electrically conductive mesh or expanded metal material (e.g. having apertures). Covering 854 is attached to conductors 832 or support structure 844 by welding or other comparable fixture. According to any particular preferred embodiment, the apertures within the mesh (or expanded metal material) create flow paths for circulation of the plating solution, increase the surface area for the anode, and further promote uniform transmission of the ultrasonic energy.

According to any of the preferred embodiments, the ability to perform plating of a rotogravure cylinder 820 directly out of solution using a non-dissolvable anode 830 eliminates the need to place unprotected solid metallic material (i.e. copper nuggets or any other unprotected anode susceptible to corrosion or chemical attack) in close proximity to cylinder 820. This configuration substantially reduces or eliminates uneven or undesirable deposits on a cylinder as a result of the sludge caused by dissolution of an unprotected anode or other unprotected surfaces. The plating process according to any preferred embodiments is thereby intended to produce a more uniform, consistent grain structure of the plated material as well as to speed the plating by allowing more energy (i.e. a higher current density on the plated surface) to be applied during plating without adverse effects.

As shown in FIG. 42, a transducer element 850, or plurality of transducer elements can be readily installed within plating tank 812 to introduce ultrasonic wave energy to facilitate the plating process. Multiple ultrasonic transducer elements can be installed in the plating tank (preferably disposed beneath non-dissolvable anode 832 as shown in FIGS. 42, 45 and 46) to ensure coverage (i.e. transmission of ultrasonic wave energy to) along the entire length of the surface of cylinder 820. The transducer elements 850 (shown as two elements 850*a* and 850*b*) are electrically coupled to a control system (shown schematically in FIG. 11) and are provided to introduce ultrasonic wave energy into plating tank 812. Transducer elements 850 can be of any type disclosed or of any other suitable type that may be known to those who review this disclosure, and can be mounted or inserted according to any suitable method.

Alternative embodiments may employ various arrangements of transducer elements to optimize plating (and deplating) performance in view of design and environmental factors (such as the ultrasonic energy intensity, flow conditions, sizes, shapes and attenuation of the tank, anode system, cylinder, etc.). According to a preferred embodiment, transducer elements 850 include a protective surface material. Transducer elements 850 are configured and positioned to assist with the plating process (e.g. to facilitate consistency of ion migration through the electrolytic fluid), and to prevent any fouling buildup on the various elements of apparatus 810.

As shown in FIG. 40, according to a preferred embodiment, the electrolytic fluid supply system functions as a closed circuit system. (As is apparent, this system is similar in structure and operation to other embodiments previously disclosed.) A supply of electrolytic fluid F is provided into plating tank 812 by at least one spray bar 862 (two are shown), which consists of a section of pipe or tube extending laterally along or near the bottom of plating tank 812. Each spray bar 862 has a series of apertures along its length (similar to as shown at least partially in FIG. 2) that provide for a constant and relatively well-dispersed flow of electrolytic fluid into plating tank 812 from a holding tank 814 (e.g. a reservoir). Preferably, holding tank 814 is disposed beneath plating tank 812 so as to capture any flow of electrolytic fluid travelling over weir 872 in plating tank 812. (Electrolytic fluid F is maintained at its own level in holding tank 814.) Other methods or arrangements may be used to maintain the flow and level of the fluid (i.e. a pump), and may be implemented in or with alternate configurations of the plating tank and holding tank.

Electrolytic fluid F may build up heat and increase in temperature over time during the plating (or deplating) process and therefore holding tank 814 is equipped with a fluid cooling system 816 (e.g. a suitable heat exchanger for such fluid of a type known in the art). Likewise, electrolytic fluid may need to be heated from an ambient temperature to a higher temperature at the outset of the plating process and therefore holding tank 814 is also equipped with a fluid heating system 818 (e.g. a suitable heat exchanger for such fluid of a type known in the art). The temperature regulating system for the plating solution can be coupled to an automatic control system that operates from information obtained by temperature sensors in or near one or both tanks, and to control other parameters that may be monitored during the process, according to known arrangements. Before the electroplating process begins, the ultrasonic system may be energized to provide for agitation of electrolytic fluid and/or for cleaning of the system to provide for better contact and plating performance.

A pair of supply pipes 860 feed spray bars 862 with a supply flow of electrolytic fluid F. Supply pipes 860 are each coupled to a circulation pump 864 configured and operated according to a known arrangement that may or may not have a filter 866. According to an exemplary embodiment, filter 866 (or a system of multiple filters) is used to reduce minimize the amount of sludge in the plating solution or in plating tank 812 that may otherwise come into contact or near contact with cylinder 820. Circulation pumps 864 draw electrolytic fluid F from holding tank 814 into inlets in each of supply pipes 860 and force it under pressure into spray bars 862 where it is reintroduced through apertures into plating tank 812 for the electroplating process. In a preferred embodiment, each of the spray bars 862 extends along the bottom of plating tank 812, rising horizontally from holding tank 814 and turning at an elbow to run horizontally along and beneath mounting structure 143. According to alternative embodiments, the apparatus could include one pump coupled to either a single spray bar or a spray bar manifold system, or any other combination of elements that provide for the suitable supply of electrolytic fluid F into plating tank 812. According to any preferred embodiment, holding tank 814, supply pipes 860, spray bars 862, filters 866, circulation pumps 864, heating system 818, cooling system 816, transducer elements 850, or other pieces that may be exposed to the plating solution (electrolytic fluid F) may be formed from a material substantially resilient to the plating solution, or include a surface material substantially resilient to the plating solution along their (individually or collectively) entire surface area, along substantial portions of their (individually or collectively) surface area, along part of their (individually or collectively) surface area, or strategically placed along those surfaces that may be exposed to corrosion or chemical attack.

The electrolytic fluid may be of a composition known to those who review this disclosure. In the instance of copper plating, preferably, the plating solution is refreshed by adding copper sulfate, copper oxides, cuprous oxide (such as that described in U.S. Pat. No. 5,707,438 incorporated by reference herein), or the like to holding tank 814.

According to a preferred embodiment, the concentration of the plating solution is maintained by the controlled addition of the copper sulfate, copper oxide, cuprous oxide, etc. Preferably, the concentration of the plating solution is controlled by a sensor array 868 (i.e. a Baumé sensor) in or near one or both tanks (shown schematically in FIGS. 40 and 42) of a type known to those who may review this disclosure. According to an exemplary embodiment, the concentration of the plating solution is controlled by pumping the solution through a clear tube with an optical device hooked up to a controller (e.g. a computing device); when the controller detects a low concentration (e.g. by more light passing through the solution than the threshold) it triggers a valve to deliver or introduce (preferably from a separate container) a refreshed solution or a material that will refresh the solution (i.e. copper sulfate, copper oxide, cuprous oxide, etc.) directly or indirectly into the plating tank; refreshing the plating solution continues until the concentration rises sufficiently to trigger the controller to shut the valve.

The plating process according to the preferred embodiments is intended to produce a more uniform, consistent grain structure of the plated material and decrease the need of polishing to a minimum. Utilizing ultrasonic energy in conjunction with plating directly out of solution using a non-dissolvable anode 830, minimizes the amount of copper (or other) sludge that moves toward cylinder 820 and enables a more uniform and consistent grain structure on the plated surface of cylinder 820.

According to a particularly preferred embodiment, the apparatus may employ a modular ultrasonic generator (e.g. Model No. MW GTI/GPI from Martin Walter) with at least one cylindrical "push-pull" transducer element (e.g. suitably positioned within the tank for efficient operation in the particular application); according to alternative embodiments, the transducer elements can be any of a variety of other types, installed on other tank surfaces and/or other orientations; the generator may be of any suitable type.

Although only a few exemplary embodiments of this invention have been described in detail above, those skilled in the art will readily appreciate that many modifications are possible in the exemplary embodiments (such as variations in sizes, structures, shapes and proportions of the various elements, values of the process parameters, mounting arrangements, or use of materials) without materially departing from the novel teachings and advantages of this invention. Other sequences of method steps may be employed. Accordingly, all such modifications are intended to be included within the scope of the invention as defined in the following claims. In the claims, each means-plus-function clause is intended to cover the structures described herein as performing the recited function and not only structural equivalents but also equivalent structures. Other substitutions, modifications, changes and omissions may be made in the design, operating conditions and arrangement of the preferred embodiments without departing from the spirit of the invention as expressed in the appended claims.

What is claimed is:

1. An apparatus for electroplating and deplating a rotogravure cylinder connectable to a current source out of a plating solution, the apparatus comprising:

a plating tank adapted to rotatably maintain the cylinder and to contain the plating solution so that the cylinder is at least partially disposed into the plating solution;

a non-dissolvable conductor partially disposed within the plating solution and connectable to the current source, wherein the non-dissolvable conductor includes a conductive core and a conductive surface material substantially resilient to the plating solution, the surface material covering at least a portion of the conductive core; and an ultrasonic system to introduce wave energy into the plating solution including at least one transducer element mountable within the plating tank and connectable to a power generator adapted to provide electrical energy to the at least one transducer element.

2. The apparatus of claim 1 wherein the conductive surface material further comprises:

a first conductive material; and at least one second conductive material.

3. The apparatus of claim 2 wherein the surface material is graphite.

4. The apparatus of claim 2 wherein the conductive core is copper or lead.

5. The apparatus of claim 2 wherein the conductive core is solid.

6. The apparatus of claim 2 wherein the conductive core comprises a plurality of conductive elements.

7. The apparatus of claim 2 further comprising a covering attached to the conductor.

8. The apparatus of claim 7 wherein the covering includes an expanded piece of metal or a mesh.

9. The apparatus of claim 1 further comprising a sensor array.

10. The apparatus of claim 1 wherein the non-dissolvable conductor is disposed around each side of the cylinder.

11. The apparatus of claim 1 wherein the non-dissolvable conductor includes a plurality of conductive portions.

12. The apparatus of claim 11 wherein the plurality of conductive portions are separated by a partition.

13. The apparatus of claim 12 wherein the partition includes an expanded piece of metal or a mesh.

14. The apparatus of claim 11 wherein the conductor portions are independently coupled to the current source.

15. The apparatus of claim 1 further comprising a reflector disposed in the plating tank beneath the transducer element.

16. The apparatus of claim 1 further comprising:

a holding tank;

a circulation pump providing flow of plating solution from the holding tank to the plating tank; and a weir maintaining a level of plating solution in the plating tank.

17. The apparatus of claim 16 wherein the holding tank further comprises a fluid heating system and a fluid cooling system.

18. The apparatus of claim 16 further comprising a filter for filtering the plating solution flowing from the holding tank to the plating tank.

19. The apparatus of claim 16 wherein the plating tank further comprises a surface material substantially resilient to the plating solution.

20. The apparatus of claim 16 wherein the holding tank further comprises a surface material substantially resilient to the plating solution.

21. The apparatus of claim 16 further comprising a sensor array.

22. An apparatus for electroplating a rotogravure cylinder connectable to a current source out of a plating solution, the apparatus comprising:

a plating tank adapted to rotatably maintain the cylinder and to contain the plating solution so that the cylinder is at least partially disposed into the plating solution;

a non-dissolvable conductor partially disposed within the plating solution and connectable to the current source, wherein the non-dissolvable conductor includes a conductive core and a conductive surface material substantially resilient to the plating solution, the surface material covering at least a portion of the conductive core.

23. An apparatus for electroplating a rotogravure cylinder connectable to a current source out of a plating solution, the apparatus comprising:

a plating tank adapted to rotatably maintain the cylinder and to contain the plating solution so that the cylinder is at least partially disposed into the plating solution;

a non-dissolvable conductor partially disposed within the plating solution and connectable to the current source, wherein the non-dissolvable conductor including a plurality of conductive cores and a conductive surface material substantially resilient to the plating solution covering at least a portion of the conductive cores; and an ultrasonic system to introduce wave energy into the plating solution including at least one transducer element mountable within the plating tank to the mounting structure and a power generator adapted to provide electrical energy to the at least one transducer element.

* * * * *